US011059648B2

(12) United States Patent
Orsini et al.

(10) Patent No.: US 11,059,648 B2
(45) Date of Patent: Jul. 13, 2021

(54) METHOD AND SYSTEM FOR FORMING CUSHION PACKAGES FOR OBJECT PROTECTION

(71) Applicant: Sealed Air Corporation (US), Charlotte, NC (US)

(72) Inventors: Thomas P. Orsini, Sterling, MA (US); Robert J. Simonelli, Worcester, MA (US); Russell T. Christman, Dunstable, MA (US); Robert J. O'Dowd, Denver, NC (US); Mark Ryan Garceau, Bethlehem, CT (US); Michael Kalinowski, Nashua, NH (US); Zi K. Chan, Lowell, MA (US); Steven E. Maston, Princeton, MA (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 16/624,068

(22) PCT Filed: Jun. 15, 2018

(86) PCT No.: PCT/US2018/037823
§ 371 (c)(1),
(2) Date: Dec. 18, 2019

(87) PCT Pub. No.: WO2018/236687
PCT Pub. Date: Dec. 27, 2018

(65) Prior Publication Data

US 2020/0377278 A1 Dec. 3, 2020

Related U.S. Application Data

(60) Provisional application No. 62/521,659, filed on Jun. 19, 2017.

(51) Int. Cl.
*B65B 9/067* (2012.01)
*B65B 9/073* (2012.01)
(Continued)

(52) U.S. Cl.
CPC ..... *B65D 81/03* (2013.01); *B31D 5/0073* (2013.01); *B65B 9/067* (2013.01); *B65B 9/073* (2013.01);
(Continued)

(58) Field of Classification Search
CPC ..... B65B 9/06; B65B 9/067; B65B 9/073; B65B 55/20; B65B 2220/18;
(Continued)

(56) References Cited

U.S. PATENT DOCUMENTS 3,142,599 A 7/1964 Chavannes
3,208,898 A 9/1965 Chavannes et al.
(Continued)

FOREIGN PATENT DOCUMENTS

CN 102107750 A 6/2011
GB 1150033 A 4/1969
(Continued)

OTHER PUBLICATIONS

Written Opinion of the International searching authority in PCT/US2018/037823 dated Dec. 27, 2018.

*Primary Examiner* — Stephen F. Gerrity
(74) *Attorney, Agent, or Firm* — Jon M. Isaacson

(57) ABSTRACT

A cushion package can be formed around an object. The object can be removed from and reinserted into the cushion package. The cushion package includes a cushion material (104) having a longitudinal length and two longitudinal edges (110). The two longitudinal edges (110) of the cushion material are folded into an overlapping position to form a tube of the cushion material. The cushion package includes
(Continued)

first and second transverse seals (148,150) in the tube of the cushion material. The first and second transverse seals (148,150) respectively form first and second ends of the cushion package. Each of the first transverse seal and the second transverse seal (148,150) seals the cushion material with the two longitudinal edges (110) in the overlapping position. The two longitudinal edges (110) of the cushion material are uncoupled between the first transverse seal and the second transverse seal (148,150).

18 Claims, 12 Drawing Sheets

(51) Int. Cl.

| | |
|---|---|
| ***B65B 35/24*** | (2006.01) |
| ***B65B 53/02*** | (2006.01) |
| ***B65B 55/20*** | (2006.01) |
| ***B65D 81/03*** | (2006.01) |
| ***B31D 5/00*** | (2017.01) |
| ***B65B 31/00*** | (2006.01) |
| ***B65C 1/02*** | (2006.01) |
| ***B65C 3/26*** | (2006.01) |
| ***B65D 75/38*** | (2006.01) |

(52) U.S. Cl.
CPC ..... *B65B 31/006* (2013.01); *B65B 35/24* (2013.01); *B65B 53/02* (2013.01); *B65B 55/20* (2013.01); *B65C 1/021* (2013.01); *B65C 3/26* (2013.01); *B65D 75/38* (2013.01); *B31D 2205/0023* (2013.01); *B65B 2220/18* (2013.01); *B65B 2220/20* (2013.01)

(58) Field of Classification Search
CPC ..... B65B 2220/20; B31D 5/0073; B31D 2205/0023; B65D 31/04; B65D 75/38; B65D 81/03
USPC ..... 53/449, 450, 455, 170, 550, 553, 562; 206/521
See application file for complete search history.

(56) References Cited

U.S. PATENT DOCUMENTS 3,285,793 A 11/1966 Chavannes
3,473,288 A 10/1969 Nakamura et al.
3,508,992 A 4/1970 Chavannes
3,544,340 A * 12/1970 Miller et al. ..... B65B 25/068 426/410
3,586,565 A 6/1971 Fielding
3,616,155 A 10/1971 Chavannes
3,623,891 A * 11/1971 Coffey ..... B65D 75/26 426/130
3,660,189 A 5/1972 Troy
3,693,319 A * 9/1972 Hunsader ..... B65B 51/30 53/518
3,958,390 A * 5/1976 Pringle, Jr. et al. ..... B65B 9/06 53/433
4,181,548 A 1/1980 Weingarten
4,184,904 A 1/1980 Gaffney
4,219,988 A 9/1980 Shanklin et al.
4,415,398 A 11/1983 Ottaviano
4,576,669 A 3/1986 Caputo
4,579,516 A 4/1986 Caputo
5,161,350 A * 11/1992 Nakamura ..... B65B 9/067 53/133.4
5,348,984 A 9/1994 Lee
5,462,974 A 10/1995 Lee
5,667,728 A 9/1997 Lee
6,629,777 B2 10/2003 Tanaka et al.
6,635,039 B1 10/2003 Levy
6,800,162 B2 10/2004 Kannankeril et al.
6,860,083 B2 * 3/2005 Torre ..... B65B 9/067 53/55
6,982,113 B2 1/2006 Kannankeril et al.
7,018,495 B2 3/2006 Kannankeril et al.
7,128,211 B2 10/2006 Nishi et al.
7,165,375 B2 1/2007 O'Dowd
7,174,697 B2 2/2007 Hada et al.
7,220,476 B2 5/2007 Sperry et al.
7,223,461 B2 5/2007 Kannankeril et al.
7,429,304 B2 9/2008 Mcnamara et al.
7,721,781 B2 5/2010 Sperry et al.
7,950,433 B2 5/2011 Sperry et al.
8,157,096 B2 4/2012 Liao et al.
8,707,660 B2 * 4/2014 Howes ..... B65B 9/06 53/450
8,911,340 B2 12/2014 Zhang et al.
10,336,483 B1 * 7/2019 Kumar ..... B65B 9/2056
2004/0216429 A1 11/2004 Tanaka et al.
2006/0062949 A1 * 3/2006 Hanaichi etal. ..... B65B 9/06 428/35.2
2006/0218881 A1 * 10/2006 Sperry etal. ..... B65B 35/10 53/411
2007/0090011 A1 * 4/2007 Ballestrazzi ..... B65B 9/06 206/459.5
2007/0131739 A1 6/2007 Ponti
2008/0073238 A1 3/2008 Liao et al.
2008/0280744 A1 11/2008 Tanaka et al.
2009/0038979 A1 * 2/2009 Spindler ..... B65D 27/00 206/521
2010/0043353 A1 2/2010 Piucci et al.
2014/0130461 A1 5/2014 Johan
2014/0314978 A1 10/2014 Lepine et al.
2015/0075114 A1 3/2015 Murch et al.
2016/0318638 A1 11/2016 Simonelli et al.
2018/0141686 A1 5/2018 Christman et al.

FOREIGN PATENT DOCUMENTS

GB 1458877 A * 12/1976 ..... B65B 9/06
GB 2475770 A 6/2011
WO 2015075568 A1 5/2015
WO 2016202313 A2 12/2016
WO 2018026984 A1 2/2018
WO 2018170222 A1 9/2018
WO 2018170274 A1 9/2018

* cited by examiner

METHOD AND SYSTEM FOR FORMING CUSHION PACKAGES FOR OBJECT PROTECTION

BACKGROUND

The present disclosure is in the technical field of object protection. More particularly, the present disclosure is directed to cushion packages formed to hold and protect an object.

Consumers frequently purchase goods from mail-order or internet retailers, which package and ship the goods to the purchasing consumer via a postal service or other carrier. Millions of such packages are shipped each day. These items are normally packaged in small containers, such as a box or envelope. To protect the items during shipment, they are typically packaged with some form of protective dunnage that may be wrapped around the item or stuffed into the container to prevent movement of the item and to protect it from shock.

A common type of packaging envelope is known as a "padded mailer." Padded mailers are generally shipping envelopes that have padded walls to protect the contents of the mailer. Padded mailers generally include a single or double wall envelope, with paper dunnage or air cellular cushioning material to protect the packaged object. While such padded mailers have been commercially successful, they are not without drawbacks. For instance, because trapped or confined air is generally the cushioning medium, the space required to store such mailers is not insignificant. Further, in order not to require an inordinately large amount of storage space, the padded mailers are typically limited to having relatively thin padding. In another example, inflatable mailers (i.e., mailers that have an integral inflatable cushioning material) can be inflated just prior to packaging and shipment, but inflation of these inflatable mailers can be a slow, cumbersome, and labor-intensive process. Moreover, padded mailers are typically used to protect objects during shipment, but are typically not used at other times, such as times when objects are stored in inventory.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a method of forming a cushion package includes feeding a cushion material from a supply of the cushion material and folding the cushion material. The cushion material having two longitudinal edges and the cushion material is folded as the cushion material is being fed until the cushion material is formed into a tube of the cushion material and the two longitudinal edges are in an overlapping position. The method also includes forming a first transverse seal in the tube of the cushion material after folding the cushion material and forming a second transverse seal in the tube of the cushion material longitudinally spaced away from the first transverse seal. The first transverse seal forms a first end of the cushion package and the second transverse seal forms a second end of the cushion package. Each of the first transverse seal and the second transverse seal seals the cushion material with the two longitudinal edges in the overlapping position. In one example, the two longitudinal edges of the cushion material are uncoupled between the first and second transverse seals.

In another example, the method further includes feeding an object onto the cushion material before the two longitudinal edges are in the overlapping position. In another example, the object is located within the tube of the cushion material after the tube of the cushion material is formed. In another example, the object is located between the first and second transverse seals after the first and second transverse seals are formed. In another example, the method further includes determining a longitudinal length of the object and determining a longitudinal length of the cushion package based on the longitudinal length of the object. In another example, the first and second transverse seals are formed based on the determined longitudinal length of the cushion package. In another example, the method further includes determining a height of the object and determining the longitudinal length of the cushion package based further on the height of the object. In another example, the method further includes reading an object identifier from the object, where the longitudinal length of the cushion package is determined based on the object identifier. In another example, the method further includes placing a label on an exterior of the cushion package, where the label includes at least one of an indication of the object, an indication of a shipping destination of the object, or an indication of an order associated with the object. In another example, the label is applied to the exterior of the cushion package before either of the first transverse seal or the second transverse seal is formed. In another example, the method further includes reading an object identifier associated with the object before the object is fed onto the cushion material. In another example, the method further includes associating a package identifier with the cushion package, where the package identifier is based on the object identifier, storing the cushion package with the associated package identifier in an inventory, and retrieving the cushion package from the inventory for shipment based on the package identifier.

In another example, the method further includes feeding a plurality of objects onto the cushion material and forming a plurality of cushion packages, where each of the plurality of cushion packages is formed around one or more of the plurality of objects. In another example, the method further includes tracking a number of the plurality of objects fed on to the cushion material and automatically initiating an order for addition objects when the number of the plurality of objects reaches a predetermined number.

In another example, the method further includes holding the two longitudinal edges in the overlapping position as the cushion material is fed from a location where the two longitudinal edges are in the overlapping position and a location where the first and second transverse seals are formed. In another example, the method further includes the two longitudinal edges are held in the overlapping position at least by one roller located above the two longitudinal edges in the overlapping position. In another example, the two longitudinal edges are held in the overlapping position at least by an overhead conveyor, where the overhead conveyor has a hanging underside that contacts the tube of the cushion material at least where the two longitudinal edges are in the overlapping position.

In another example, the cushion material is an inflatable cellular material and the method further includes inflating the inflatable cellular material before folding the cushion material into the tube of the cushion material. In another example, the method further includes placing the cushion package in an external container. In another example, the external container includes an opaque shrink wrap, and an inner surface of the opaque shrink wrap is in contact with an exterior surface of the cushion package. In another example, the external container includes a bag formed from a polymer-based film. In another example, the external container includes a box formed from a corrugated paper material. In another example, the method further includes applying a label to an exterior of the external container, where the label includes at least one of an indication of an object, an indication of a shipping destination of the external container, or an indication of an order associated with the external container.

In another example, feeding the cushion material from the supply of the cushion material comprises feeding the cushion material intermittently in order to form cushion packages intermittently. In another example, feeding the cushion material from the supply of the cushion material comprises feeding the cushion material continuously in order to form cushion packages continuously.

In another embodiment, a cushion package includes a cushion material having a longitudinal length and two longitudinal edges. The cushion material forms a tube and the two longitudinal edges of the cushion material are in an overlapping position when the cushion material forms the tube. The cushion package further includes a first transverse seal in the tube of the cushion material and a second transverse seal in the tube of the cushion material. The first transverse seal forms a first end of the cushion package and the first transverse seal forms a second end of the cushion package. Each of the first transverse seal and the second transverse seal seals the cushion material with the two longitudinal edges in the overlapping position. The two longitudinal edges of the cushion material are uncoupled between the first transverse seal and the second transverse seal.

In one example, the cushion package further includes an object located within the tube of the cushion material. In another example, a longitudinal distance between the first and second transverse seals is determined based on one or more of a longitudinal length of the object, a transverse width of the object, or a height of the object. In another example, a length of uncoupled portions of the two longitudinal edges of the cushion material between the first and second transverse seals permits the first and second transverse seals to remain sealed while the object is removed from the cushion package. In another example, the length of uncoupled portions of the two longitudinal edges of the cushion material between the first and second transverse seals permits the first and second transverse seals to remain sealed while the object is reinserted into the cushion package after the object has been removed from the cushioned package. In another example, the cushion package further includes a label on an exterior of the cushion package, where the label includes at least one of an indication of the object, an indication of a shipping destination of the object, or an indication of an order associated with the object.

In another example, the cushion material includes an inflatable cellular material. In another example, the cushion material is at least partially transparent. In another example, the cushion package further includes an external container in which the cushion material is located. In another example, the external container includes one or more of an opaque shrink wrap, a bag formed from a polymer-based film, or a box formed from a corrugated paper material.

In another embodiment, a system for creating a cushion package includes a supply of cushion material configured to feed the cushion material in an unfolded state. The cushion material has two longitudinal edges. The system further includes a folding system configured to folding the cushion material from the unfolded state into a tube of the cushion material with the two longitudinal edges in an overlapping position. The system further includes a sealing mechanism configured to form a first transverse seal in the tube of the cushion material and to form a second transverse seal in the tube of the cushion material downstream of the first transverse seal. The first transverse seal forms a first end of the cushion package and the second transverse seal forms a second end of the cushion package. Each of the first transverse seal and the second transverse seal seals the cushion material with the two longitudinal edges in the overlapping position.

In one example, the folding system comprises at least two pairs of forming rollers configured to direct the cushion material from the unfolded state into the tube of the cushion material. In another example, the two longitudinal edges of the cushion material are uncoupled between the first and second transverse seals. In another example, the system further includes a conveyor system configured to feed objects onto the cushion material before the two longitudinal edges are in the overlapping position.

In one example, the conveyor system includes one or more of an infeed conveyor configured to feed objects at an uncontrolled spacing, an infeed spacing conveyor configured to feed objects at a controlled spacing, a machine conveyor configured to support the objects while the cushion material is folded by the folding system, or an end conveyor configured to support the objects during one or more of formation of the first and second transverse seals by the sealing mechanism or after the cushion packages are formed.

In another example, the conveyor system is configured to feed at least one object onto the cushion material so that the tube of the cushion material is formed around the at least one object. In another example, the at least one object is located between the first and second transverse seals after the first and second transverse seals are formed by the sealing mechanism. In another example, the system further includes a controller configured to determine a longitudinal length of the at least one object and to determine a longitudinal length of the cushion package based on the longitudinal length of the object. In another example, the controller is configured to control the sealing mechanism to form the first and second transverse seals based on the determined longitudinal length of the cushion package. In another example, the controller is further configured to determine a height of the at least one object and to determine the longitudinal length of the cushion package based further on the height of the at least one object. In another example, the system further includes an infeed product scanner configured to read an object identifier from the at least one object, where the controller is configured to determine the longitudinal length of the cushion package based on the object identifier. In another example, the system further includes a labeling mechanism configured to apply a label to an exterior of the cushion package, where the label includes at least one of an indication of the at least one object, an indication of a shipping destination of the at least one object, or an indication of an order associated with the at least one object. In another example, the labeling mechanism includes a printer configured to print the label, the labeling mechanism is configured to apply the label by either printing the label directly on the exterior of the of the cushion package or printing the label on an adhesive medium and applying the adhesive medium to the exterior of the of the cushion package, and a location of the labeling mechanism is either upstream of the sealing mechanism and after the cushion package is folded into the tube or downstream of the sealing mechanism. In another example, the system further includes a communication mechanism configured to communicate with a warehouse management system, and wherein the system is configured to perform at least one of: obtaining information about the object from the warehouse management system via the communication mechanism or sending information about the cushion package to the warehouse management system.

In another example, the system further includes a holding mechanism configured to hold the two longitudinal edges in the overlapping position as the cushion material is fed between the folding system and the sealing mechanism. In another example, the holding mechanism comprises at least one roller located above the two longitudinal edges in the overlapping position. In another example, the holding mechanism comprises an overhead conveyor, where the overhead conveyor has a hanging underside configured to contact the tube of the cushion material at least where the two longitudinal edges are in the overlapping position. In another example, the cushion material is an inflatable cellular material and the system further includes an inflation device configured to inflate the inflatable cellular material before the cushion material is folded into the tube of the cushion material.

In another embodiment, a system includes a cushion formation system, a conveyor system, a shell formation system, and a sealing mechanism. The cushion formation system is configured to form cushion material in to a tube of the cushion material. The conveyor system is configured to feed objects onto the cushion material so that the object is fed into the tube of the cushion material. The shell formation system is configured to form a shell material into a tube of the shell material and the system is configured to feed the tube of the cushion material into the tube of the shell material while the object is inside the tube of the cushion material. The sealing mechanism configured to form a first transverse seal upstream of the object and to form a second transverse seal downstream of the object. The first transverse seal is formed through both the cushion material in the tube of the cushion material and the shell material in the tube of the cushion material and the shell material. The second transverse seal is formed through both the cushion material in the tube of the cushion material and the shell material in the tube of the cushion material and the shell material.

In one example, the cushion material is an inflatable cellular material. In another example, the shell material is a polymer-based film. In another example, the system further includes a folding system configured to folding the cushion material from an unfolded state into the tube of the cushion material, where the cushion material includes two longitudinal edges and the two longitudinal edges are in an overlapping position in the tube of the cushion material. In another example, a distance between the first transverse seal and the second transverse seal is based on a length of the object. In another example, the distance between the first transverse seal and the second transverse seal is further based on a height of the object.

In another embodiment, a system includes a first wrapping system configured to receive an object and to form a first package around the object. The first wrapping system includes an input scanning system configured to scan the object before the first package is formed around the object and an output scanning system configured to perform a scan the first package after the first package has been formed around the object. The system further includes a second wrapping system configured to receive, from the first wrapping system, the first package with the object inside the first package and to form a second package around the first package. The first wrapping packaging is configured to communicate information about the first package to the second wrapping system.

In one example, the first wrapping system is configured to form the first package from a cushion material and the second wrapping system is configured to form the second package from a polymer-based film. In another example, the first wrapping system is configured to form the first package from a polymer-based film, and the second wrapping system is configured to form the second package from a cushion material. In another example, the information about the first package is based on data generated by the output scanning system from the scan of the first package. In another example, the information about the first package includes at least one of a position of the first package, a dimension of the first package, an identifier of the object, shipping information associated with the object, or information associated with the object obtained from a warehouse management system.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure describes embodiments of cushioning packages that are capable of protecting objects. In some cases, the cushioning packages are usable to protect objects during shipping or other transportation. In some cases, the cushioning packages are formed from air cellular materials, from foamed materials, or from any other type of cushioning material. In some cases, the objects are able to be removed from the cushioning packages and then reinserted into the cushioning packages. This ability to have the objects removed from and reinserted into the cushion packages allows the cushion packages to be used more than once, such as to ship an object from a seller to a customer as part of a sale of the object and then to ship the object from the customer to the seller as part of a return of the object.

In some embodiments, cushion packages are formed by feeding objects onto an unfolded cushion material, folding the cushion material into a tube around the objects, and then forming transverse seals in the tube around the objects. In some examples, longitudinal edges of the cushion material are in an overlapping position after the cushion material is folded into the tube. In some example, the longitudinal edges of the cushion material remain uncoupled between the transverse seals. In some cases, the distance between the transverse seals allows for enough space between the uncoupled longitudinal edges in order to remove the object from and reinsert the object into the cushion package. The cushion package with one or more objects inside can be placed in an external container, such as a box, a bag, or shrink wrap material, prior to being shipped.

In some embodiments, a cushion package is formed together with a shell material. Objects are fed onto a cushion material and the cushion material is formed into a tube around the objects. A shell material is formed into a tube around the tube of the cushion material. Transverse seals are then formed through both the tube of the shell material and the tube of the cushion material. The transverse seals are formed on opposite sides of the objects to form a cushion package around the objects.

In some embodiments, a cushion package formation system is used in combination with another system. For example, a cushion package formation system can be used in combination with a shell material formation system. In some examples, the cushion package machine forms cushion packages around the objects, and the cushion packages are then formed to the other system for the formation of another package around the cushion package. In some examples, the cushion package formation system and the other system are configured to communicate with each other and one of the cushion package system and the other system is a simplified system because of the information it receives from the other system.

Figure 1:
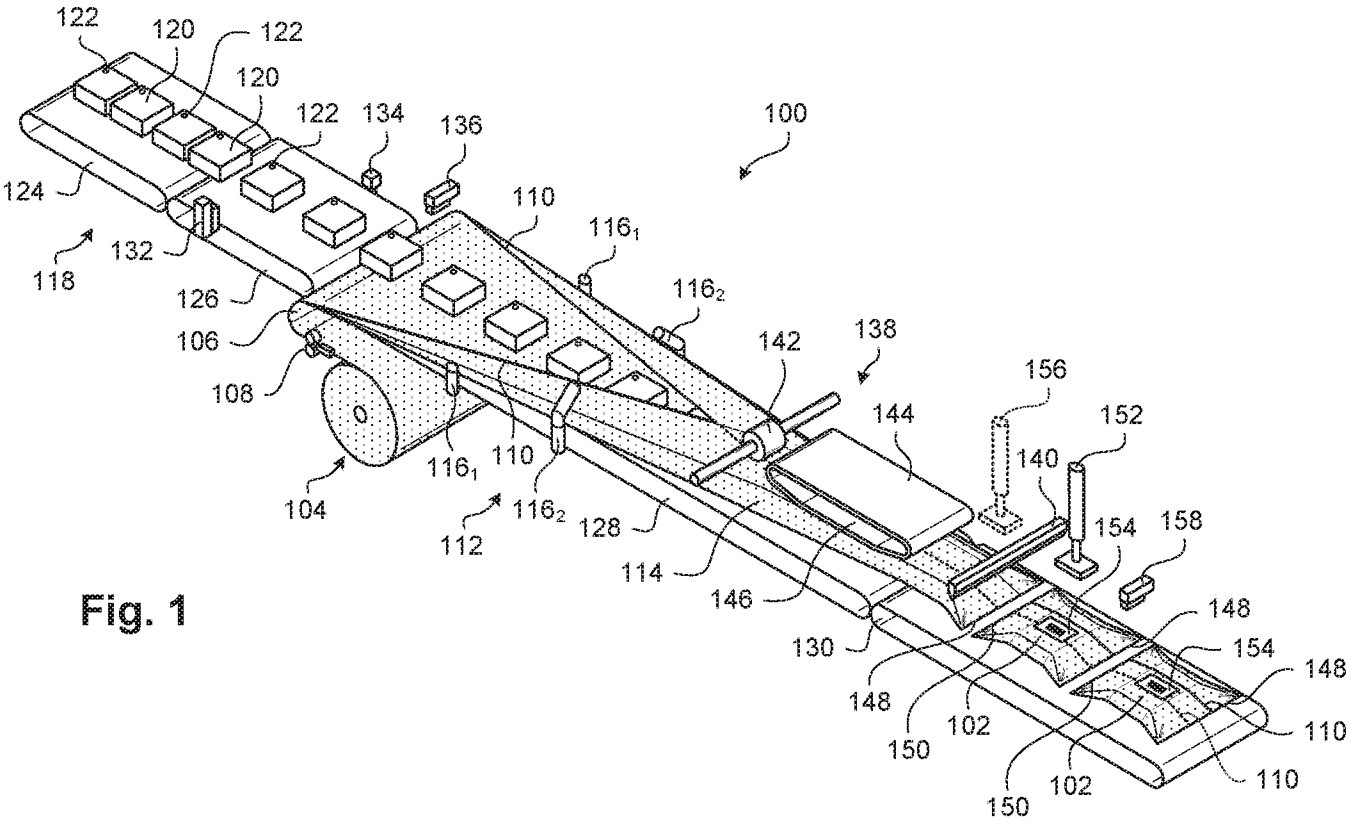
FIG. 1 depicts an embodiment of a system for creating cushion packages, in accordance with the embodiments disclosed herein.

Depicted in FIG. 1 is an embodiment of a system 100 for creating cushion packages 102. The system 100 includes a supply 104 of cushion material 106. In the depicted embodiment, the supply 104 is a roll of the cushion material 106. In other embodiments, the supply 104 could be sheets of the cushion material 106, fanfolded stacks of the cushion material 106, or any other supply of the cushion material 106. In the depicted embodiment, the cushion material 106 is a flexible sheet material.

In some examples, the cushion material 106 is an inflated air cellular material. As used herein, the term "air cellular material" herein refers to bubble cushioning material, such as BUBBLE WRAP® air cushioning material sold by Sealed Air Corporation, where a first film or laminate is formed (e.g., thermoformed, embossed, calendared, or otherwise processed) to define a plurality of cavities and a second film or laminate is adhered to the first film or laminate in order to close the cavities. Examples of air cellular materials are shown in U.S. Pat. Nos. 3,142,599, 3,208,898, 3,285,793, 3,508,992, 3,586,565, 3,616,155, 3,660,189, 4,181,548, 4,184,904, 4,415,398, 4,576,669, 4,579,516, 6,800,162, 6,982,113, 7,018,495, 7,165,375, 7,220,476, 7,223,461, 7,429,304, 7,721,781, and 7,950,433, and U.S. Published Patent Application Nos. 2014/0314978 and 2015/0075114, the disclosures of which are hereby incorporated by reference in their entirety.

In some examples, the cushion material 106 is a foamed material. Methods for manufacturing such foamed materials are well known, as disclosed in e.g., U.S. Pat. Nos. 5,348,984, 5,462,974, and 5,667,728, the contents of all of which are incorporated herein by reference in their entirety. A common material used to form foamed materials is low density polyethylene (LDPE). In some embodiments, foamed materials have a density ranging from about 0.5 to about 15 pounds/$ft^3$. Foamed materials may be in the form of a sheet or plank having a thickness ranging from about 0.015 to about 5 inches. In producing the sheets of foamed materials, any conventional chemical or physical blowing agents may be used, such as a physical blowing agent (e.g., carbon dioxide, ethane, propane, n-butane, isobutane, pentane, hexane, butadiene, acetone, methylene chloride, any of the chlorofluorocarbons, hydrochlorofluorocarbons, hydrofluorocarbons, or any mixture thereof). If desired or necessary, various additives may also be included with the polymer, such as a nucleating agent (e.g., zinc oxide, zirconium oxide, silica, talc, etc.) and/or an aging modifier (e.g., a fatty acid ester, a fatty acid amide, a hydroxyl amide, etc.).

In one particular embodiment, the supply 104 includes a roll of an inflatable web of air cellular material in a deflated state. As the inflatable web is unrolled, it is fed through an inflation and sealing machine 108. The inflation and sealing machine 108 inflates and seals cells in the air cellular material so that the air cellular material is in an inflated state. In this embodiment, the cushion material 106 is the inflated air cellular material. Examples of inflation and sealing machines are described in U.S. Pat. No. 7,721,781 and U.S. Published Patent Application No. 2014/0314978, the contents of which are hereby incorporated by reference in their entirety.

The cushion material 106 has longitudinal edges 110. The system 100 also includes a folding system 112. In the depicted embodiment, the folding system 112 includes two pairs of rollers: rollers $\mathbf{116}_1$ and rollers $\mathbf{116}_2$. In the depicted embodiment, the rollers $\mathbf{116}_1$ are oriented vertically and the rollers $\mathbf{116}_2$ are oriented at a non-vertical and non-horizontal angle; however, the rollers $\mathbf{116}_1$ and $\mathbf{116}_2$ could be any oriented at any desired angle. The folding system 112 folds the cushion material 106 from an unfolded state (e.g., the state of the cushion material 106 when it is unrolled from the supply 104) into a tube 114 of the cushion material 106. In the tube 114 of the cushion material 106, the longitudinal edges 110 of the cushion material 106 are in an overlapping position.

The system 100 also includes a conveyor system 118 that is configured to feed objects 120 and/or the cushioning material 106. As used herein, an "object" may comprise a single item for packaging or grouping of several distinct items where the grouping is to be in a single package. Further, an object may include an accompanying informational item, such as a packing slip, tracking code, a manifest, an invoice, or printed sheet comprising machine-readable information (e.g., a bar code) for sensing by an object reader (e.g., a bar code scanner). In the depicted embodiment, each of the objects 120 includes an object identifier 122. In some examples, the object identifier includes one or more of a barcode, a quick response (QR) code, a radio frequency identification (RFID) tag, any other form a machine-readable information, human-readable information, or any combination thereof.

In the depicted embodiment, the conveyor system 118 includes an infeed conveyor 124, an infeed spacing conveyor 126, a machine conveyor 128, and an end conveyor 130. The infeed conveyor 124 is configured to feed the objects 120. The objects 120 are at an uncontrolled spacing on the infeed conveyor 124. The infeed spacing conveyor 126 is configured to feed the objects 120 after they leave the infeed conveyor 124. The infeed spacing conveyor 126 is configured to be controlled by a controller or other computing device (not shown) to provide a particular spacing between the objects 120. In the depicted embodiment, the system 100 includes a sizing sensor 132, a spacing sensor 134, and an identifier sensor 136. The sizing sensor 132 is configured to determine one or more dimensions of the objects 120, such as a longitudinal length of the objects 120, a height of the objects 120, or a transverse width of the objects 120. The spacing sensor 134 is configured to determine a longitudinal spacing between consecutive objects 120. In some examples, the sizing sensor 132, the spacing sensor 134, and the identifier sensor 136 are configured to send signals to the controller or other computing device, and the controller or other computing device is configured to control the infeed spacing conveyor 126 and/or any other component of the system 100. In some embodiments, each of the sizing sensor 132, the spacing sensor 134, and the identifier sensor 136 includes one or more of an optical sensor (e.g., a visible light sensor, a laser sensor, or any other electromagnetic sensor), an RFID tag reader, a barcode reader, a camera, an acoustic sensor (e.g., an ultrasonic sensor), a mechanical sensor (e.g., a plunger), or any other type of sensor.

As shown in FIG. 1, the cushion material 106 is configured to be fed over the machine conveyor 128 so that the objects 120 are fed onto the cushion material 106. The machine conveyor 128 supports and feeds both the cushion material 106 and the objects 120. In the depicted embodiment, the objects 120 are fed onto the cushion material 106 while the cushion material 106 is in an unfolded state (e.g., before the longitudinal edges 110 are in the overlapping position). The conveyor system 118 is configured to feed the objects 120 onto the cushion material 106 so that the tube 114 of the cushion material 106 is formed around the objects 120.

In the depicted embodiment, the system 100 includes a holding mechanism 138 configured to hold the longitudinal edges 110 in the overlapping position as the cushion material 106 is fed between the folding system 112 and a sealing mechanism 140. In some embodiments, the holding mechanism 138 includes a roller 142 located above the longitudinal edges 110 in the overlapping position, and the roller 142 holds the longitudinal edges 110 in the overlapping position after the cushion material 106 has been folded. In some embodiments, the holding mechanism 138 includes an overhead conveyor 144 that has a hanging underside 146. The hanging underside 146 is configured to contact the tube 114 of the cushion material 106 where the longitudinal edges 110 are in the overlapping position. In some embodiments, such as the embodiment depicted in FIG. 1, the holding mechanism 138 includes both the roller 142 and the overhead conveyor 144.

The sealing mechanism 140 is configured to provide or perform, in repeating fashion, while the tube 114 is traveling: (i) a leading edge seal 148 that is transverse to tube 114, (ii) a trailing edge seal 150 transverse to the tube 114, and (iii) a transverse cut between the leading edge seal 148 and the trailing edge seal 150. Each of the leading edge seal 148 and the trailing edge seal 150 seals the cushion material 106 with the longitudinal edges 110 in the overlapping position. Preferably, one or more of the objects 120 are located inside of each of the cushion packages 102 between one of the leading edge seals 148 and one of the leading trailing edge seals 150. In some embodiments, the sealing mechanism 140 uses temperature and/or pressure to make two transverse seals (leading edge seal 148 and trailing edge seal 150) and transversely cuts between them. These transverse cuts create cushion packages 102 separated from the tube 114 of the cushion material 106. Advantageously, the sealing mechanism 140 may be adapted to simultaneously sever the cushion packages 102 from the tube 114 while forming the leading edge seal 148 and trailing edge seal 150.

Various forms of sealing mechanisms 140 are known in the art. These include, for example, rotary end sealer units that have matched heated bars mounted on rotating shafts. As the film tube passes through the rotary type, the rotation is timed so it coincides with the gap between products. A double seal is produced and the gap between the two seals is cut by an integral blade to separate individual packages. Another type of sealing mechanisms 140 is the box motion type, having a motion that describes a "box" shape so that its horizontal movement increases the contact time between the seal bars and the film. Still another type of sealing mechanisms 140 is the continuous type, which includes a sealing bar that moves down with the tube 114 while sealing. In some cases, the system 100 feeds cushion material 106 from the supply 104 intermittently in order to form cushion packages 102 intermittently. In these cases, the sealing mechanisms 140 may not need to move in a downstream direction to form the transverse seals and cuts. In other cases, the system 100 feeds cushion material 106 from the supply 104 continuously in order to form cushion packages 102 continuously. In these cases, the sealing mechanisms 140 may move in a downstream direction while forming the transverse seals and cuts.

The system 100 includes a labeling mechanism 152 that is capable of applying labels 154 to exteriors of the cushion packages 102. In some embodiments, the labels 154 include indications of the objects 120 inside the cushion packages 102, indications of shipping destinations of the objects 120 inside the cushion packages 102, and/or indications of orders associated with the objects 120 inside the cushion packages 102. In some embodiments, the labeling mechanism 152 includes a printer that prints the labels 154. In some cases, the printer prints the labels 154 directly on the exterior of the cushion packages 102. In other cases, the printer prints the labels 154 on an adhesive medium and labeling mechanism 152 applies the adhesive medium to the exterior of the of the cushion packages 102. In the depicted embodiment, the labeling mechanism 152 is located downstream of the sealing mechanism 140. In other embodiments, a labeling mechanism 156 can be located upstream of the sealing mechanism 140 (as shown in dashed lines).

In the depicted embodiment, the system 100 includes a discharge scanner 158. The discharge scanner 158 is configured to scan one or more of the cushion packages 102 themselves, the labels 154 on the cushion packages 102, or the object identifiers 122 on the objects 120 insides of the cushion packages 102. The data generated by the discharge scanner 158 may be used to verify that the objects 120 have been wrapped in one of the cushion packages 102. In some embodiments, the data generated by the discharge scanner 158 may be communicated from the system 100 to other systems that may process the cushion packages 102, as will be discussed in greater detail below.

Figure 2C:
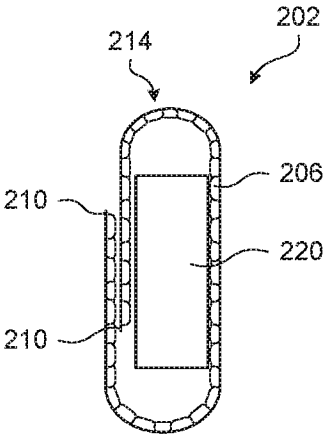
FIGS. 2A, 2B, and 2C depict a top view, a side cross-sectional view, and an end cross-sectional view, respectively, of a cushion package that can be made by the system depicted in FIG. 1, in accordance with the embodiments disclosed herein.
Figure 2A:
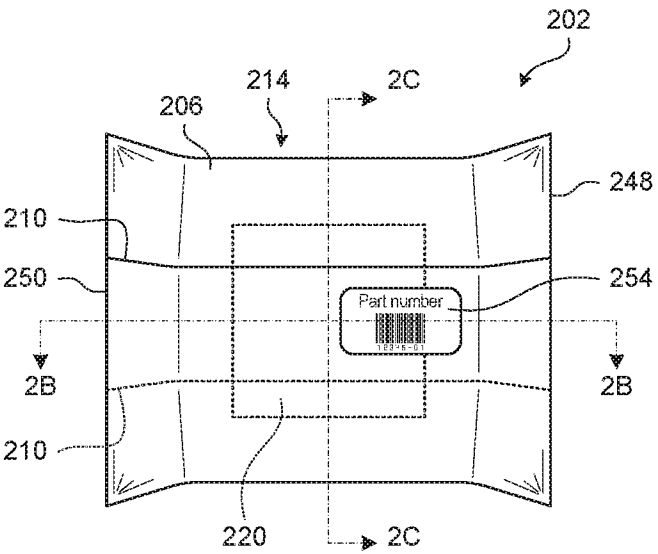
Figure 2B:
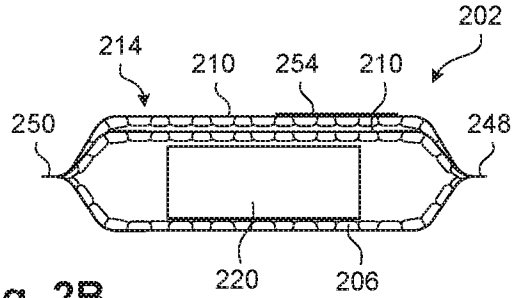

One example of one of the cushion packages 102 is depicted as cushion package 202 in FIGS. 2A to 2C. More specifically, FIGS. 2A, 2B, and 2C depict a top view, a side cross-sectional view, and an end cross-sectional view, respectively, of the cushion package 202. The cushion material 206 has two longitudinal edges 210. As can be seen in FIG. 2C, the cushion material 206 forms a tube 214 with the longitudinal edges 210 in an overlapping position when the cushion material 206 forms the tube 214. In the depicted embodiment, an object 220 is located inside the tube 214 formed by the cushion material 206. In some embodiments, the cushion material 206 includes an inflatable cellular material that provides physical protection for the object 220. In some embodiments, the cushion material 206 is at least partially transparent such that the object 220 is at least partially visible to an observer from outside of the cushion package 202.

The cushion package 202 includes a transverse seal 248 in the tube 214 of the cushion material 206. The transverse seal 248 forms one end of the cushion package 202. The cushion package 202 also includes a transverse seal 250 in the tube 214 of the cushion material 206. The transverse seal 250 forms another end of the cushion package 202. As can be seen in FIGS. 2A and 2B, each of the transverse seal 248 and the transverse seal 250 seals the cushion material 206 with the longitudinal edges 210 in the overlapping position. In the depicted embodiment, as can be seen in FIGS. 2B and 2C, the longitudinal edges 210 are uncoupled between the transverse seal 248 and the transverse seal 250. This uncoupled aspect of the longitudinal edges 210 may be useful in removing the object 220 from the cushion package 202, as will be described below. The cushion package 202 and the cushion material 206 have a longitudinal length between the transverse seal 248 and the transverse seal 250.

In some embodiments, the longitudinal distance between the transverse seal 248 and the transverse seal 250 is determined based on characteristics of the object 220. In some examples, the longitudinal distance between the transverse seal 248 and the transverse seal 250 is determined based on one or more of a longitudinal length of the object 220, a transverse width of the object 220, or a height of the object 220. In the depicted embodiment, a label 254 is applied to the exterior of the cushion package 202. The label 254 includes an indication of the object 220. In other examples, the label 254 can have an indication of a shipping destination of the object 220 and/or an indication of an order associated with the object 220 in addition to or in place of the indication of the object 220.

Figure 3A:
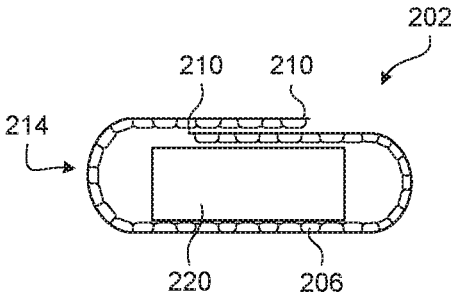
FIGS. 3A to 3E depict cross-sectional end views of a series of instances of an example of a way in which a recipient may use the cushion package shown in FIGS. 2A to 2C, in accordance with the embodiments disclosed herein.

An example of the way in which a recipient may remove the object 220 from and reinsert the object 220 into the cushion package 202 in a series of cross-sectional end views of instances in FIGS. 3A to 3E. Although FIGS. 3A to 3E are described herein with respect to a recipient, it will be apparent that any person other than a recipient could use the cushion package 202 and the object 220 in similar ways. In FIG. 3A, the object 220 is inside of the package 202. This may be the case when the recipient receives the cushion package 202 and the object 220, such as when the recipient receives them in a shipment.

Figure 3B:
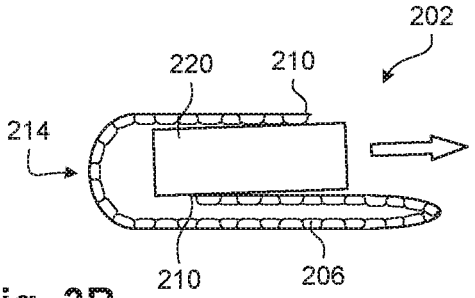

In FIG. 3B, the recipient has moved the object 220 into a position between the uncoupled longitudinal edges 210 of the tube 214 of the cushion package 202. In order to bring the object 220 into the position between the uncoupled longitudinal edges 210 of the tube 214, the recipient may slide the object 220 to one side of the tube 214 and/or rotate the object 220 within the tube 214 such that one end of the object 220 passes between the uncoupled longitudinal edges 210. In some embodiments, this maneuvering of the object 220 in this manner is unlikely to occur without intentional human interaction so that the object 220 is not unintentionally removed from the cushion package 202.

Figure 3C:
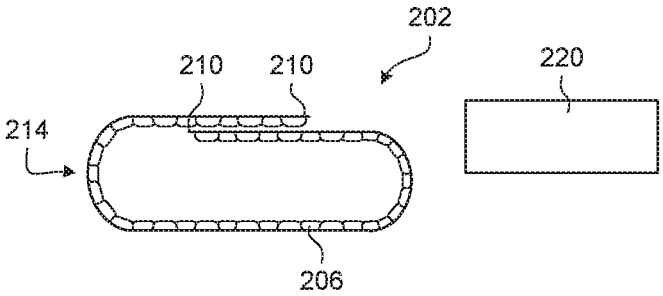
Figure 3D:
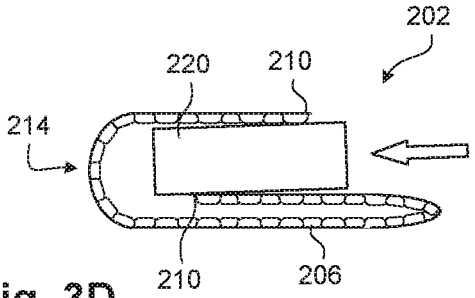
Figure 3E:
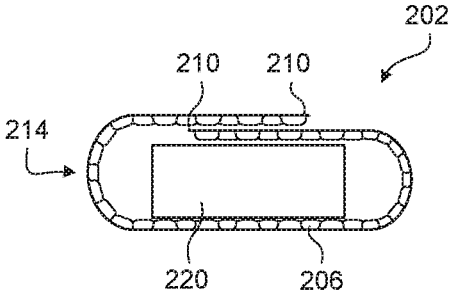

From the position shown in FIG. 3B, the recipient may continue to slide the object 220 between the uncoupled longitudinal edges 210 of the tube 214 until the object 220 is fully removed from the cushion package 202, as depicted in FIG. 3C. In some embodiments, the uncoupled portions of the longitudinal edges 210 of the cushion material 206 between the transverse seals 248 and 250 permit the transverse seals 248 and 250 to remain sealed while the object 220 is removed from the cushion package 202. In some embodiments, the removal of the object 220 from the cushion package 202 does not result in permanent deformation of the cushion package 202.

After the object 220 has been removed from the cushion package 202, the recipient may decide to reinsert the object 220 into the cushion package 202. This may be advantageous if the recipient will be returning the object 220 to the sender of the shipment (e.g., the seller of the object 220). As shown in FIG. 3D, the recipient has again slid the object 220 between the uncoupled longitudinal edges 210 of the tube 214. The recipient continues to slide the object 220 between the uncoupled longitudinal edges 210 of the tube 214 until the object 220 is fully reinserted into the cushion package 202. In some embodiments, the length of uncoupled portions of the longitudinal edges 210 of the cushion material 206 between the transverse seals 248 and 250 permits the transverse seals 248 and 250 to remain sealed while the object 220 is reinserted into the cushion package 202 after the object 220 has been removed from the cushioned package 202.

The system 100 depicted in FIG. 1 and the cushion packages 102 and 202 can be used in a number of different settings. In one example, the system 100 can be used at the intake of a warehouse or other distribution facility. When intaking the objects 120, the objects 120 may be onto the infeed conveyor 124 and then allowed to pass through the remainder of the system 100. This allows the objects 120 to be scanned by one or more of the sizing sensor 132, the spacing sensor 134, or the identifier sensor 136 to identify the objects 120 and/or obtain information about the objects 120. In addition, the system 100 is capable of placing the objects 120 in cushion packages 102 before the objects 120 are stored in the warehouse. The objects 120 can be stored in the warehouse when they are inside of the cushion packages 102 to prevent any inadvertent damage. Before the objects 120 are shipped, the cushion packages 102 can be placed in an external container and then shipped to individual customers with the cushion packages 102 providing protection during shipping provided in the same cushion packages 102 that provided protection in the warehouse. As described earlier, the labeling mechanism 152 can label the cushion packages 102 with labels 154 that aid in retrieving the objects 120 from inventory in the warehouse prior to shipment.

In another example, the system 100 can be used immediately before the objects 120 are placed in an external container for shipping. When the objects 120 are retrieved from inventory in the warehouse, the objects 120 are fed through the system 100 to wrap the objects 120 in the cushion packages 102. The cushion packages can then be placed into an external container for shipping. In some embodiments, the number of objects 120 fed onto the cushion material 106 can be tracked automatically by a computing device or other controller that is in communication with the identifier sensor 136. In one example, the computing device or other controller automatically initiates an order for addition objects when the number of the objects 120 that has been tracked reaches a predetermined number.

Figure 4A:
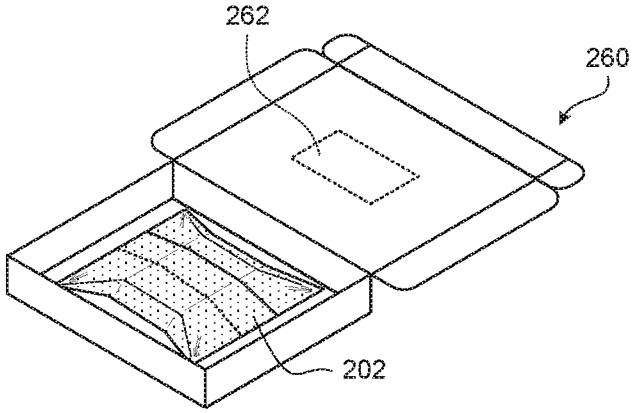
FIG. 4A to 4C depict various examples of the cushion package shown in FIGS. 2A to 2C placed in external containers, in accordance with the embodiments disclosed herein.
Figure 4B:
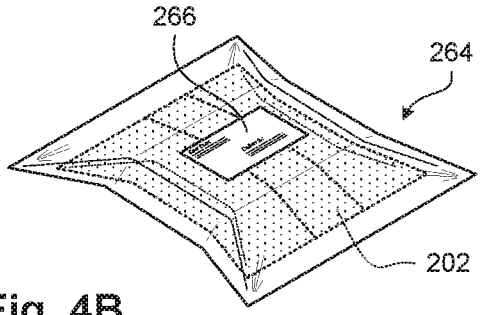
Figure 4C:
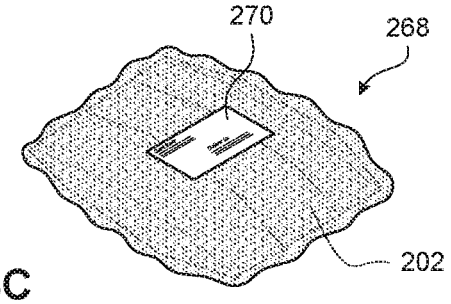

As noted above, any of the cushion packages 102 and 202 can be placed into an external container, such as a shipping container. FIGS. 4A to 4C depict various examples of the cushion package 202 in external containers. In FIG. 4A, the cushion package 202 has been placed in a box 260 formed from a corrugated paper material. In the depicted embodiment, the box 260 is open with the lid uncovered from the cushion package 202. A label 262 has been applied on an exterior of the lid of the box 260. In some examples, the label 262 includes at least one of an indication of the object 220 inside the cushion package 202, an indication of a shipping destination of the box 260, or an indication of an order associated with the box 260.

In FIG. 4B, the cushion package 202 has been wrapped in a bag 264 formed from a polymer-based film. In the depicted embodiment, the bag 264 is closed with the cushion package 202 located inside. In some embodiments, the bag 264 is formed by a form-fill-seal system, such as in the examples described in U.S. Pat. No. 4,219,988 and International Publication Nos. PCT/US2016/030630 and PCT/US2016/029523, the content of all of which are hereby incorporated by reference in their entirety. A label 266 has been applied on an exterior of the bag 264. In some examples, the label 266 includes at least one of an indication of the object 220 inside the cushion package 202, an indication of a shipping destination of the bag 264, or an indication of an order associated with the bag 264.

In FIG. 4C, the cushion package 202 has been wrapped in an opaque shrink wrap 268 with the inner surface of the opaque shrink wrap 268 in contact with the exterior surface of the cushion package 202. In the depicted embodiment, the opaque shrink wrap 268 is closed with the cushion package 202 located inside. In some embodiments, the opaque shrink wrap 268 is formed by a form-fill-seal system. Examples of opaque shrink wrap and form-fill-seal system using opaque shrink wrap are described in U.S. Application Nos. 62/370,258, 62/472,051, and 62/472,059, the content of all of which are hereby incorporated by reference in their entirety. A label 270 has been applied on an exterior of the opaque shrink wrap 268. In some examples, the label 270 includes at least one of an indication of the object 220 inside the cushion package 202, an indication of a shipping destination of the opaque shrink wrap 268, or an indication of an order associated with the opaque shrink wrap 268.

Figure 5A:
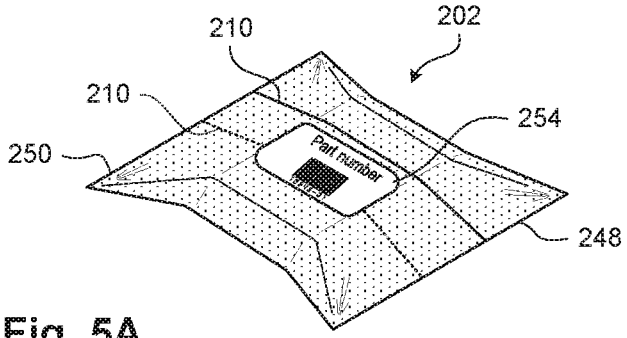
FIGS. 5A and 5B depict examples of placement of a label on the exterior surface of the cushion package shown in FIGS. 2A to 2C, in accordance with the embodiments disclosed herein.
Figure 5B:
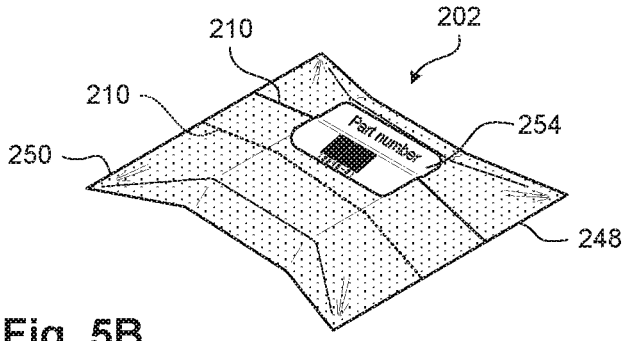

As noted above, a label 254 can be applied to the exterior surface of the cushion package 202. Examples of placement of the label 254 on the exterior surface of the cushion package 202 are shown in FIGS. 5A and 5B. In FIG. 5A, the label 254 is applied to the cushion package 202 so that the label 254 does not span the exposed longitudinal edge 210. This placement of the label 254 allows the object 220 inside of the cushion package 202 to be removed without removing or altering the label 254 in any way. In FIG. 5B, the label 254 is applied to the cushion package 202 so that the label 254 spans the exposed longitudinal edge 210. This placement of the label 254 deters unintentional removal of the object 220 from the cushion package 202. In this case, it may be desirable for a recipient to remove or cut the label 254 before attempting to remove the object 220 from the cushion package 202.

Figure 6:
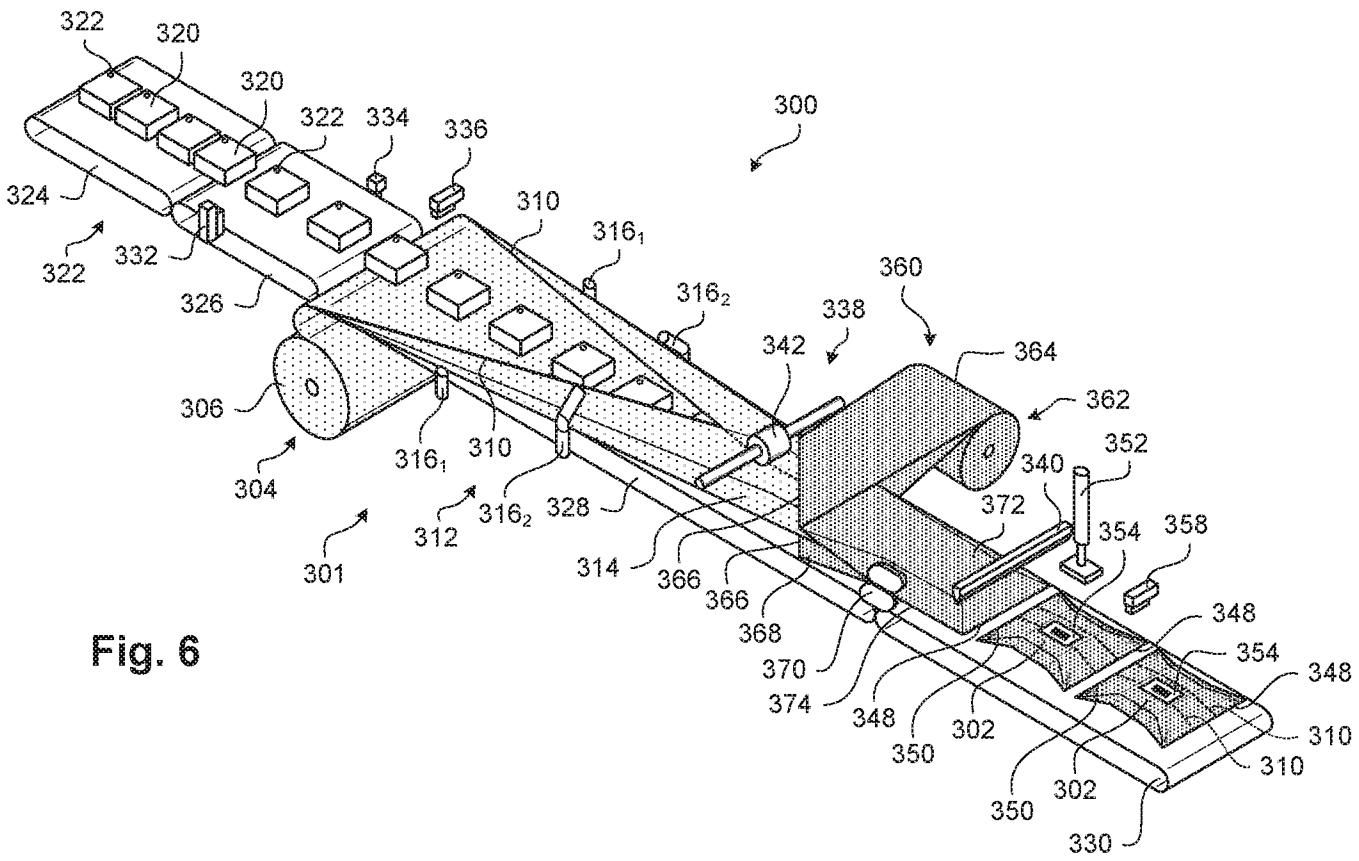
FIG. 6 depicts an embodiment of a system for creating cushion and shell packages, in accordance with the embodiments disclosed herein.

Some of the embodiments described above include a cushion packages formed separately from an external container and then placed inside of an external container for shipment. In other embodiments, a cushion package and an external container can be formed together. Depicted in FIG. 6 is an embodiment of a system 300 for creating cushion packages 302. The system 300 includes a supply 304 of cushion material 306. In the depicted embodiment, the supply 304 is a roll of the cushion material 306. In other embodiments, the supply 304 could be sheets of the cushion material 306, fanfolded stacks of the cushion material 306, or any other supply of the cushion material 306. In the depicted embodiment, the cushion material 306 is a flexible sheet material. In some examples, the cushion material 306 is an inflated air cellular material or a foamed material.

In one particular embodiment, the supply 304 includes a roll of an inflatable web of air cellular material in a deflated state. As the inflatable web is unrolled, it is fed through an inflation and sealing machine (not shown). The inflation and sealing machine inflates and seals cells in the air cellular material so that the air cellular material is in an inflated state. In this embodiment, the cushion material 306 is the inflated air cellular material. Examples of inflation and sealing machines are described in U.S. Pat. No. 7,721,781 and U.S. Published Patent Application No. 2014/0314978, the contents of which are hereby incorporated by reference in their entirety.

The cushion material 306 has longitudinal edges 310. The system 300 also includes a folding system 312. In the depicted embodiment, the folding system 312 includes rollers $\mathbf{316}_1$ and rollers $\mathbf{316}_2$. In the depicted embodiment, the rollers $\mathbf{316}_1$ are oriented vertically and the rollers $\mathbf{316}_2$ are oriented at a non-vertical and non-horizontal angle; however, the rollers $\mathbf{316}_1$ and $\mathbf{316}_2$ could be any oriented at any desired angle. The folding system 312 folds the cushion material 306 from an unfolded state (e.g., the state of the cushion material 306 when it is unrolled from the supply 304) into a tube 314 of the cushion material 306. In the depicted embodiment, the tube 314 of the cushion material 306 includes the longitudinal edges 310 of the cushion material 306 are in an overlapping position. In other embodiments, the tube 314 of the cushion material 306 could include the longitudinal edges 310 sealed together by a longitudinal sealer. In some cases, one or more of the supply 304 of the cushion material 306, the folding system 312, and the holding mechanism 338 form a cushion formation system 301 that forms the cushion material 306 in to the tube 314 of the cushion material 306.

The system 300 also includes a conveyor system 318 that is configured to feed objects 320 and/or the cushioning material 306. In the depicted embodiment, each of the objects 320 includes an object identifier 322. In some examples, the object identifier includes one or more of a barcode, a quick response (QR) code, a radio frequency identification (RFID) tag, any other form a machine-readable information, human-readable information, or any combination thereof.

In the depicted embodiment, the conveyor system 318 includes an infeed conveyor 324, an infeed spacing conveyor 326, a machine conveyor 328, and an end conveyor 330. The infeed conveyor 324 is configured to feed the objects 320. The objects 320 are at an uncontrolled spacing on the infeed conveyor 324. The infeed spacing conveyor 326 is configured to feed the objects 320 after they leave the infeed conveyor 324. The infeed spacing conveyor 326 is configured to be controlled by a controller or other computing device (not shown) to provide a particular spacing between the objects 320. In the depicted embodiment, the system 300 includes a sizing sensor 332, a spacing sensor 334, and an identifier sensor 336. The sizing sensor 332 is configured to determine one or more dimensions of the objects 320, such as a longitudinal length of the objects 320, a height of the objects 320, or a transverse width of the objects 320. The spacing sensor 334 is configured to determine a longitudinal spacing between consecutive objects 320. In some examples, the sizing sensor 332, the spacing sensor 334, and the identifier sensor 336 are configured to send signals to the controller or other computing device, and the controller or other computing device is configured to control the infeed spacing conveyor 326 and/or any other component of the system 300. In some embodiments, each of the sizing sensor 332, the spacing sensor 334, and the identifier sensor 336 includes an optical sensor (e.g., a visible light sensor, a laser sensor, or any other electromagnetic sensor), an RFID tag reader, a barcode reader, a camera, an acoustic sensor (e.g., an ultrasonic sensor), a mechanical sensor (e.g., a plunger), or any other type of sensor.

As shown in FIG. 3, the cushion material 306 is configured to be fed over the machine conveyor 328 so that the objects 320 are fed onto the cushion material 306. The machine conveyor 328 supports and feeds both the cushion material 306 and the objects 320. In the depicted embodiment, the objects 320 are fed onto the cushion material 306 while the cushion material 306 is in an unfolded state (e.g., before the longitudinal edges 310 are in the overlapping position). The conveyor system 318 is configured to feed the objects 320 onto the cushion material 306 so that the tube 314 of the cushion material 306 is formed around the objects 320.

In the depicted embodiment, the system 300 includes a holding mechanism 338 configured to hold the longitudinal edges 310 in the overlapping position as the cushion material 306 is fed between the folding system 312 and a shell formation system 360. In the depicted embodiment, the holding mechanism 338 includes a roller 342 located above the longitudinal edges 310 in the overlapping position, and the roller 342 holds the longitudinal edges 310 in the overlapping position after the cushion material 306 has been folded. In other embodiments, the holding mechanism 338 includes an overhead conveyor that has a hanging underside or a combination of both the roller 342 and an overhead conveyor. Although not depicted in FIG. 6, the holding mechanism 338 could also include an overhead conveyor located downstream of the roller 342 that holds the tube 314 of the cushion material 306 in the overlapping position until the tube 314 of the cushion material 314 reaches a shell formation system 360.

The system 300 also includes the shell formation system 360. The shell formation system 360 includes a supply 362 of a shell material 364. In some embodiments, the shell material 364 is a polymer-based film. In the depicted embodiment, the shell material 364 is center-folded when it is on the supply 362. As the shell material 364 is fed from the supply 362, the two halves are separated and fed to inverting arms 366, which invert the shell material 364 to form an interior space 368 and direct the shell material 364 in the same direction as the tube 314 of the cushioning material 306. The tube 314 is directed into the interior space 368 formed by the shell material 364 after the shell material 364 has been inverted by the inverting arms 366.

The shell formation system 360 also includes a longitudinal sealer 370 that forms a side seal 374 in the open longitudinal edges of the shell material 364. The longitudinal sealer 370 forms the shell material 364 into a tube 372 of the shell material 364. In the depicted embodiment, the longitudinal sealer 370 is located at the side of the tube 372 to form the side seal 374 in the longitudinal edges of the shell material 364. In other embodiments, the longitudinal sealer 370 may be located beneath the tube 372, where the sealer may form, for example, a center fin seal between two edge portions of the shell material 364. As two edge portion of the shell material 364 are brought together at the longitudinal sealer 370 to form the tube 372, they are sealed together, for example, by a combination of heat and pressure. Appropriate longitudinal sealers are known in the art, and include, for example, heat sealers.

The system includes a sealing mechanism 340 that forms transverse seals in the cushion material 306 and the shell material 364. The sealing mechanism 340 is configured to provide or perform, in repeating fashion, while the tube 314 and the tube 372 are traveling: (i) a leading edge seal 348 that is transverse to tube 314 and the tube 372, (ii) a trailing edge seal 350 transverse to the tube 314 and the tube 372, and (iii) a transverse cut between the leading edge seal 348 and the trailing edge seal 350. Each of the leading edge seal 348 and the trailing edge seal 350 seals the cushion material 306 and the shell material 364. In the depicted embodiment, the longitudinal edges 110 are in the overlapping position. Preferably, one or more of the objects 320 are located inside of each of the cushion packages 302 between one of the leading edge seals 348 and one of the trailing edge seals 350. In some embodiments, the sealing mechanism 340 uses temperature and/or pressure to make two transverse seals (leading edge seal 348 and trailing edge seal 350) and transversely cuts between them. These transverse cuts create cushion packages 302 separated from the tube 314 of the cushion material 306 and the tube 372 of the shell material 364. Advantageously, the sealing mechanism 340 may be adapted to simultaneously sever the cushion packages 302 from the tube 314 and the tube 372 while forming the leading edge seal 348 and trailing edge seal 350.

The system 300 includes a labeling mechanism 352 that is capable of applying labels 354 to exteriors of the cushion packages 302. In some embodiments, the labels 354 include indications of the objects 320 inside the cushion packages 302, indications of shipping destinations of the objects 320 inside the cushion packages 302, and/or indications of orders associated with the objects 320 inside the cushion packages 302. In some embodiments, the labeling mechanism 352 includes a printer that prints the labels 354. In some cases, the printer prints the labels 354 directly on the exterior of the cushion packages 302. In other cases, the printer prints the labels 354 on an adhesive medium and labeling mechanism 352 applies the adhesive medium to the exterior of the of the cushion packages 302. In the depicted embodiment, the labeling mechanism 352 is located downstream of the sealing mechanism 340. In other embodiments, the labeling mechanism 352 can be located upstream of the sealing mechanism 340.

In the depicted embodiment, the system 300 includes a discharge scanner 358. The discharge scanner 358 is configured to scan one or more of the cushion packages 302 themselves, the labels 354 on the cushion packages 302, or the object identifiers 322 on the objects 320 insides of the cushion packages 302. The data generated by the discharge scanner 358 may be used to verify that the objects 320 have been wrapped in one of the cushion packages 302. In some embodiments, the data generated by the discharge scanner 358 may be communicated from the system 300 to other systems that may process the cushion packages 302, as will be discussed in greater detail below.

Figure 7C:
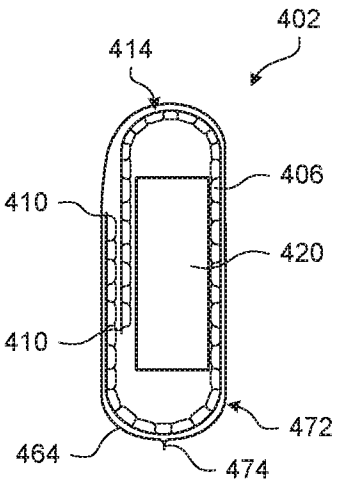
FIGS. 7A, 7B, and 7C depict a top view, a side cross-sectional view, and an end cross-sectional view, respectively, of a cushion package formed using the system shown in FIG. 6, in accordance with the embodiments disclosed herein.
Figure 7A:
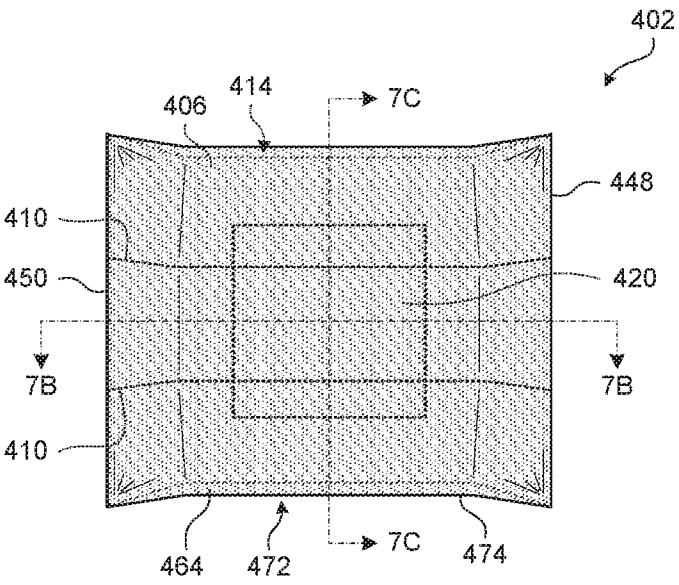
Figure 7B:
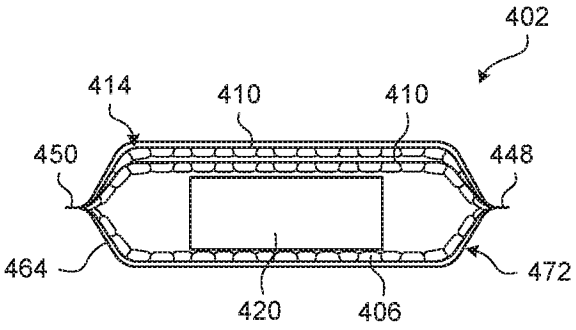

One example of one of the cushion packages 302 is depicted as cushion package 402 in FIGS. 7A to 7C. More specifically, FIGS. 7A, 7B, and 7C depict a top view, a side cross-sectional view, and an end cross-sectional view, respectively, of the cushion package 402. The cushion material 406 has two longitudinal edges 410. The shell material 464 has a side seal 474. As can be seen in FIG. 7C, the cushion material 406 forms a tube 414 with the longitudinal edges 410 in an overlapping position when the cushion material 406 forms the tube 414 and the shell material 464 forms a tube 472. In the depicted embodiment, an object 420 is located inside the tube 414 formed by the cushion material 406 and the tube 472 formed by the shell material 464. In some embodiments, the cushion material 406 includes an inflatable cellular material that provides physical protection for the object 420. In some embodiments, the shell material 464 is a polyethylene-based film that is opaque to prevent the object 420 from being viewed during shipping or other transport.

The cushion package 402 includes a transverse seal 448 in the tube 414 of the cushion material 406 and the tube 472 of the shell material 464. The transverse seal 448 forms one end of the cushion package 402. The cushion package 402 also includes a transverse seal 450 in the tube 414 of the cushion material 406 and the tube 472 of the shell material 464. The transverse seal 450 forms another end of the cushion package 402. As can be seen in FIGS. 7A and 7B, each of the transverse seal 448 and the transverse seal 450 is formed through both the cushion material 406 in the tube 414 of the cushion material 406 and the shell material 464 in the tube 472 of the shell material 464. In the depicted embodiment, as can be seen in FIGS. 7B and 7C, the longitudinal edges 410 are uncoupled between the transverse seal 448 and the transverse seal 450. In other embodiments, the longitudinal edges 410 may be sealed to each other or otherwise closed. The cushion package 402 and the cushion material 406 have a longitudinal length between the transverse seal 448 and the transverse seal 450.

In some embodiments, the longitudinal distance between the transverse seal 448 and the transverse seal 450 is determined based on characteristics of the object 420. In some examples, the longitudinal distance between the transverse seal 448 and the transverse seal 450 is determined based on one or more of a longitudinal length of the object 420, a transverse width of the object 420, or a height of the object 420. In some embodiments, a label is applied to the exterior of the cushion package 402. The label may include one or more of an indication of the object, an indication of a shipping destination of the object 420, or an indication of an order associated with the object 420.

Figure 8A:
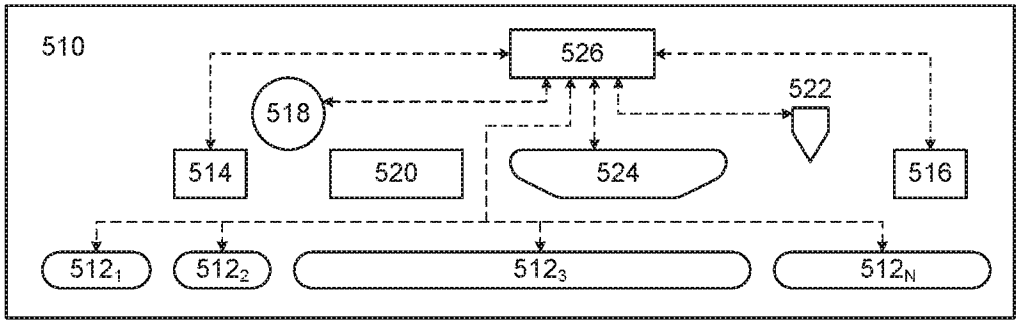
FIGS. 8A and 8B depicts embodiments of a cushion package formation system and a form-fill-seal system, respectively, that are usable together, in accordance with the embodiments disclosed herein.
Figure 8B:
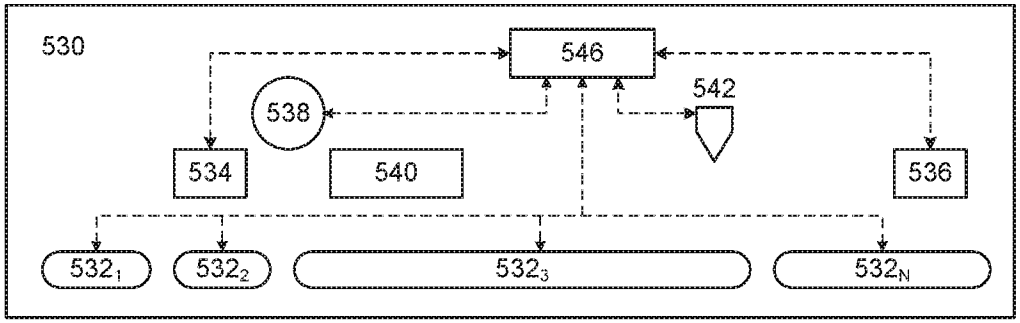
Figure 9A:
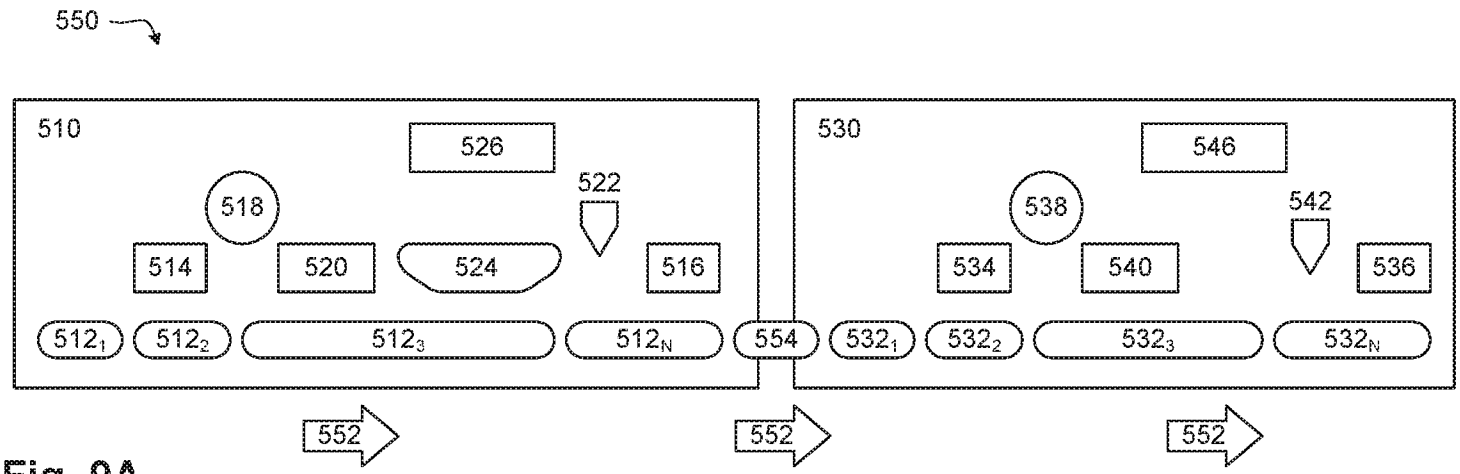
FIGS. 9A and 9B depict examples of systems that include both the cushion package formation system and the form-fill-seal system shown in FIGS. 8A and 8B, in accordance with the embodiments disclosed herein.
Figure 9B:
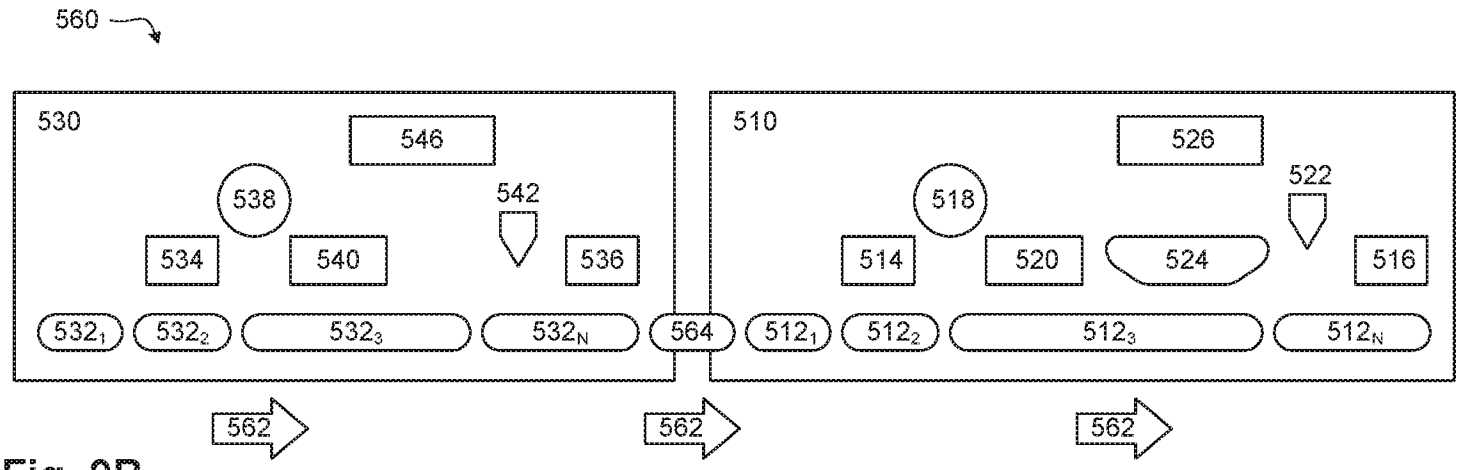
Figure 10A:
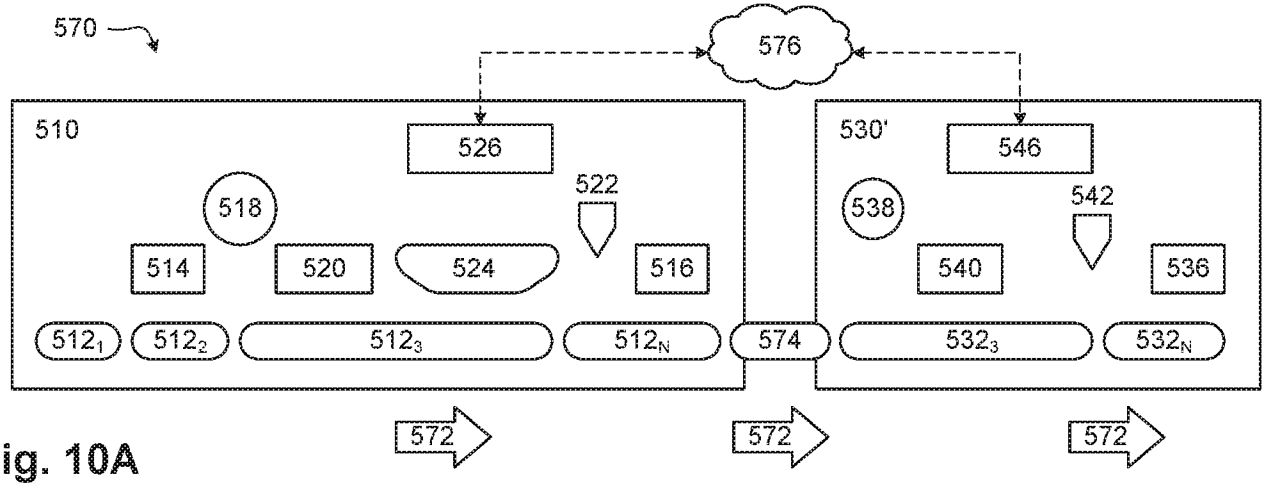
FIGS. 10A and 10B depict examples of systems that include both the cushion package formation system and the form-fill-seal system shown in FIGS. 8A and 8B, where one of the cushion package formation system and the form-fill-seal system has been simplified, in accordance with the embodiments disclosed herein.
Figure 10B:
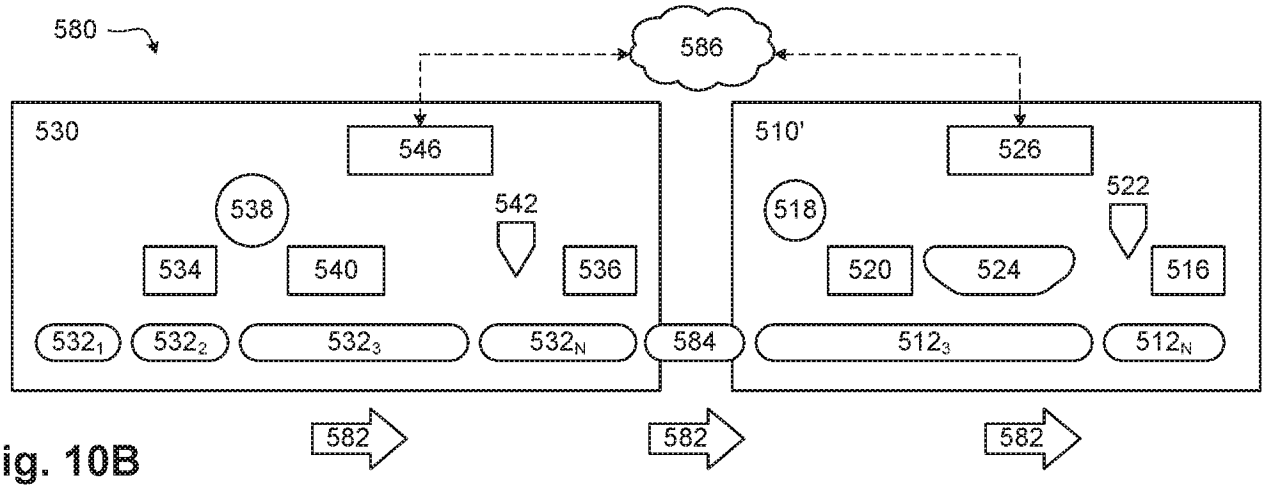

As discussed above, the embodiments of cushion package formation systems described herein (e.g., system 100 and system 300) can be used together with other systems that process the cushion packages and/or the objects. Embodiments of a cushion package formation system 510 and a form-fill-seal system 530 that are usable together are depicted in FIGS. 8A and 8B, respectively. FIGS. 9A and 9B depict examples of systems 550 and 560, respectively, that include both the cushion package formation system 510 and the form-fill-seal system 530. FIGS. 10A and 10B depict examples of systems 570 and 580, respectively, that include both the cushion package formation system 510 and the form-fill-seal system 530, where one of the cushion package formation system 510 and the form-fill-seal system 530 has been simplified.

Depicted in FIG. 8A is the embodiment of the cushion package formation system 510. The system 510 includes an infeed conveyor 5121, an infeed spacing conveyor 5122, a machine conveyor 5123, and an end conveyor 512N (collectively, conveyor system 512). The individual components of the conveyor system 512 may function in ways similar to the functions of the infeed conveyor 124, the infeed spacing conveyor 126, the machine conveyor 128, and the end conveyor 130 function in system 100. The conveyor system 512 is configured to convey objects through the system 510.

The system 510 includes an infeed scanning system 514 and an outfeed scanning system 516. The infeed scanning system 514 is configured to scan objects as they enter the system 510 along the conveyor system. In some embodiments, the infeed scanning system 514 includes one or more of a sizing sensor, a spacing sensor, and an identifier sensor. The outfeed scanning system 516 is configured to scan cushion packages as they exit the system 510. In some embodiments, the outfeed scanning system 516 includes one or more of a discharge scanner, a sizing sensor, or an identifier sensor.

The system 510 includes a supply 518 of cushion material. The system 510 is configured to feed the cushion material from the supply 518. The conveyor system 512 is configured to feed objects onto the cushion material. The system 510 includes a folding system 520 configured to folding the cushion material after it is fed from the supply 518. The folding system 520 folds the cushion material from an unfolded state into a tube of the cushion material. The system 510 includes a sealing mechanism 522 to form transverse seals in the tube of the cushion material. The sealing mechanism 522 also cuts the cushion material to form individual cushion packages between two transverse seals. In some embodiments, the conveyor system 512 is configured to feed the objects so that at least one of the objects is located inside individual cushion packages. The system 510 also includes a holding mechanism 524 that holds the cushion material in the tube shape as the cushion material is fed between the folding system 520 and the sealing mechanism 522.

The system 510 also includes a controller 526. In some embodiments, the controller 526 is a computing device. The controller 526 is in communication with components of the system 510 and is configured to receive information from and/or send control signals to the individual components. In the depicted embodiment, the controller 526 is in communication with each of the components of the conveyor system 512, the infeed scanning system 514, the outfeed scanning system 516, the supply 518, the sealing mechanism 522, and the holding mechanism 524. In the depicted embodiment, the folding system 520 is a passive system (e.g., the rollers $\mathbf{116}_1$ and $\mathbf{116}_2$) that does not provide feedback and/or receive control signals. In one example of operation of the controller 526, the controller 526 receives information from the infeed scanning system 514 about dimensions of the objects, sends control signals to the conveyor system 512 for properly conveying the objects, and sends control signals to the sealing mechanism 522 for properly spacing transverse seals around the objects. In another example of operation of the controller 526, the controller 526 receives information from the infeed scanning system 514 about spacing of the objects, sends control signals to the conveyor system 512 for properly conveying the objects, and sends control signals to the supply 518 and the holding mechanism 524 for properly advancing the cushion material around the objects. It will be apparent that the controller 526 can operate in any number of other ways to control operation of the system 510.

In some embodiments, the cushion package formation system 510 includes other components that are not depicted in FIG. 8A. In one example, the cushion package formation system 510 includes a labeling mechanism located downstream of the sealing mechanism 522. In another example, the cushion package formation system 510 includes a labeling mechanism located upstream of the sealing mechanism 522. In another example, the cushion package formation system 510 includes an inflation and sealing machine for inflating and sealing individual inflatable channels of the cushion material from the supply 518.

Depicted in FIG. 8B is the embodiment of the form-fill-seal system 530. The system 530 includes an infeed conveyor 5321, an infeed spacing conveyor 5322, a machine conveyor 5323, and an end conveyor 532N (collectively, conveyor system 532). The conveyor system 532 is configured to convey objects through the system 530. The system 530 includes an infeed scanning system 534 and an outfeed scanning system 536. The infeed scanning system 534 is configured to scan objects as they enter the system 530 along the conveyor system. In some embodiments, the infeed scanning system 534 includes one or more of a sizing sensor, a spacing sensor, and an identifier sensor. The outfeed scanning system 536 is configured to scan shell bags as they exit the system 530. In some embodiments, the outfeed scanning system 536 includes one or more of a discharge scanner, a sizing sensor, or an identifier sensor.

The system 530 includes a supply 538 of shell material. The system 530 is configured to feed the shell material from the supply 538. The system 530 includes a routing system 540 configured to route the shell material after it is fed from the supply 538. The routing system 540 routes the shell material to form a tube of the shell material within an interior space inside of the tube. In some embodiments, the routing system 540 includes inverting arms that invert the shell material. The conveyor system 532 is configured to feed objects onto the interior space of the shall material. The system 530 includes a sealing mechanism 542 to form transverse seals in the tube of the shell material. The sealing mechanism 542 also cuts the shell material to form individual shell bags between two transverse seals. In some embodiments, the conveyor system 532 is configured to feed the objects so that at least one of the objects is located inside individual shell bags.

The system 530 also includes a controller 546. In some embodiments, the controller 546 is a computing device. The controller 546 is in communication with components of the system 530 and is configured to receive information from and/or send control signals to the individual components. In the depicted embodiment, the controller 546 is in communication with each of the components of the conveyor system 532, the infeed scanning system 534, the outfeed scanning system 536, the supply 538, and the sealing mechanism 542. In the depicted embodiment, the routing system 540 is a passive system (e.g., the inverting arms 366 and the longitudinal sealer 370) that does not provide feedback and/or receive control signals. In one example of operation of the controller 546, the controller 546 receives information from the infeed scanning system 534 about dimensions of the objects, sends control signals to the conveyor system 532 for properly conveying the objects, and sends control signals to the sealing mechanism 542 for properly spacing transverse seals around the objects. In another example of operation of the controller 546, the controller 546 receives information from the infeed scanning system 534 about spacing of the objects, sends control signals to the conveyor system 532 for properly conveying the objects, and sends control signals to the supply 538 for properly advancing the shell material. It will be apparent that the controller 546 can operate in any number of other ways to control operation of the system 530.

In some embodiments, the form-fill-seal system 530 includes other components that are not depicted in FIG. 8B. In one example, the form-fill-seal system 530 includes a labeling mechanism located downstream of the sealing mechanism 542. In another example, the form-fill-seal system 530 includes a labeling mechanism located upstream of the sealing mechanism 542. In another example, the form-fill-seal system 530 includes a longitudinal sealer to create a side seal that forms the tube of the shell material.

Depicted in FIG. 9A is one embodiment of a system 550 where the cushion package formation system 510 and the form-fill-seal system 530 are used together. The system 550 is configured to package objects as they pass in a downstream direction 552. In system 550, the cushion package formation system 510 is located upstream of the form-fill-seal system 530. As objects are passed into the system 550, they are first passed into the cushion package formation system 510 and the cushion package formation system 510 forms cushion packages around the objects. The cushion packages with the objects inside are then passed to the form-fill-seal system 530. The system 550 optionally includes a conveyor 554 between the cushion package formation system 510 and the form-fill-seal system 530 in order to convey the cushion packages with the objects inside from the cushion package formation system 510 to the form-fill-seal system 530. The form-fill-seal system 530 then forms shell bags around the cushion packages with the objects inside. The form-fill-seal system 530 may optionally apply a label, such as a shipping label, to the exterior of the shell bag. As the objects exit the form-fill-seal system 530, enclosed in a cushion package and then further enclosed in a shell bag, the objects may then be shipped or otherwise handled or transported.

Depicted in FIG. 9B is another embodiment of a system 560 where the cushion package formation system 510 and the form-fill-seal system 530 are used together. The system 560 is configured to package objects as they pass in a downstream direction 562. In system 560, the form-fill-seal system 530 is located upstream of the cushion package formation system 510. As objects are passed into the system 550, they are first passed into the form-fill-seal system 530 and the form-fill-seal system 530 forms shell bags around the objects. The shell bags with the objects inside are then passed to the cushion package formation system 510. The system 560 optionally includes a conveyor 564 between the form-fill-seal system 530 and the cushion package formation system 510 in order to convey the shell bags with the objects inside from the form-fill-seal system 530 to the cushion package formation system 510. The cushion package formation system 510 then forms cushion packages around the shell bags with the objects inside. The cushion package formation system 510 may optionally apply a label, such as an identification label, to the exterior of the cushion package. As the objects exit the cushion package formation system 510, enclosed in a shell bag and then further enclosed in a cushion package, the objects may then be stored in an inventory or otherwise handled or shipped.

The systems 550 and 560 depicted in FIGS. 9A and 9B include the use of the form-fill-seal system 530 with the cushion package formation system 510. However, it will be apparent that the cushion package formation system 510 could be used with any other type of system that handles objects or cushion packages. In one example, in the system 550 shown in FIG. 9A, the form-fill-seal system 530 could be replaced by a box formation system that forms a cardboard box around the cushion packages. In another example, in the system 550 shown in FIG. 9A, the form-fill-seal system 530 could be replaced by an opaque shrink wrap system that forms heat-shrinkable opaque film around the cushion packages and then shrinks the heat-shrinkable film around the cushion packages. In yet another example, in the system 560 shown in FIG. 9B, the form-fill-seal system 530 could be replaced by a transparent shrink wrap system that forms transparent heat-shrinkable film around the objects and then shrinks the heat-shrinkable film around the objects before the object and the heat-shrunk film are passed to the cushion package formation system 510 for formation of cushion packages.

FIG. 10A depicts one example of a system 570 in which the cushion package formation system 510 and a simplified form-fill-seal system 530' are used together. The system 570 is configured to package objects as they pass in a downstream direction 572. In system 570, the cushion package formation system 510 is located upstream of the simplified form-fill-seal system 530'. As objects are passed into the system 570, they are first passed into the cushion package formation system 510 and the cushion package formation system 510 forms cushion packages around the objects. The cushion packages with the objects inside are then passed to the simplified form-fill-seal system 530'. The system 570 optionally includes a conveyor 574 between the cushion package formation system 510 and the simplified form-fill-seal system 530' in order to convey the cushion packages with the objects inside from the cushion package formation system 510 to the simplified form-fill-seal system 530'. The simplified form-fill-seal system 530' then forms shell bags around the cushion packages with the objects inside. The simplified form-fill-seal system 530' may optionally apply a label, such as a shipping label, to the exterior of the shell bag. As the objects exit the simplified form-fill-seal system 530', enclosed in a cushion package and then further enclosed in a shell bag, the objects may then be shipped or otherwise handled.

The simplified form-fill-seal system 530' is simplified compared to the form-fill-seal system 530 because the simplified form-fill-seal system 530' does not include the infeed conveyor 5321, the infeed spacing conveyor 5322, or the infeed scanning system 534. These components can be omitted from the simplified form-fill-seal system 530' because the controller 526 of the cushion package formation system 510 is in communication with the controller 546 of the simplified form-fill-seal system 530'. The controller 526 is able to receive information about the cushion packages from the outfeed scanning system 516 that would have been collected by an infeed scanning system of the simplified form-fill-seal system 530'. The controller 526 is able to commutate this information to the controller 546 so that the controller 546 obtains the information even though the simplified form-fill-seal system 530' does not have an infeed scanning system. In addition, the controller 526 is able to control the position of the cushion packages as they leave the cushion package formation system 510 and communicate their position to the controller 546. In the depicted embodiment, the controller 526 is in communication with the controller 546 via a network 576. The network 576 may be a wired network, a wireless network, or any combination thereof. The network 576 may also be a public network, a private network, or any combination thereof. In other embodiments, the controllers 526 and 546 are in direct communication with each other (e.g., without communicating via the network 576).

FIG. 10B depicts one example of a system 570 in which the form-fill-seal system 530 and a simplified cushion package formation system 510' are used together. The system 580 is configured to package objects as they pass in a downstream direction 582. In system 580, the form-fill-seal system 530 is located upstream of the simplified cushion package formation system 510'. As objects are passed into the system 580, they are first passed into the form-fill-seal system 530 and the form-fill-seal system 530 forms shell bags around the objects. The shell bags with the objects inside are then passed to the simplified cushion package formation system 510'. The system 580 optionally includes a conveyor 584 between the form-fill-seal system 530 and the simplified cushion package formation system 510' in order to convey the shell bags with the objects inside from the form-fill-seal system 530 to the simplified cushion package formation system 510'. The simplified cushion package formation system 510' then forms cushion packages around the shell bags with the objects inside. The simplified cushion package formation system 510' may optionally apply a label, such as an identifying label, to the exterior of the cushion package. As the objects exit the simplified cushion package formation system 510', enclosed in a shell bag and then further enclosed in a cushion package, the objects may then be placed in an inventory or otherwise handled or shipped.

The simplified cushion package formation system 510' is simplified compared to the cushion package formation system 510 because the simplified cushion package formation system 510' does not include the infeed conveyor 5121, the infeed spacing conveyor 5122, or the infeed scanning system 524. These components can be omitted from the simplified cushion package formation system 510' because the controller 546 of the form-fill-seal system 530 is in communication with the controller 526 of the simplified cushion package formation system 510'. The controller 546 is able to receive information about the shell bags from the outfeed scanning system 536 that would have been collected by an infeed scanning system of the simplified cushion package formation system 510'. The controller 546 is able to commutate this information to the controller 526 so that the controller 526 obtains the information even though the simplified cushion package formation system 510' does not have an infeed scanning system. In addition, the controller 546 is able to control the position of the shell bags as they leave the form-fill-seal system 530 and communicate their position to the controller 526. In the depicted embodiment, the controller 546 is in communication with the controller 526 via a network 586. The network 586 may be a wired network, a wireless network, or any combination thereof.

The network 586 may also be a public network, a private network, or any combination thereof. In other embodiments, the controllers 546 and 526 are in direct communication with each other (e.g., without communicating via the network 586).

The systems 570 and 580 depicted in FIGS. 10A and 10B include both the cushion package formation system 510 and the form-fill-seal system 530, where one of the cushion package formation system 510 and the form-fill-seal system 530 has been simplified. However, it will be apparent that the cushion package formation system 510 could be used with any other type of system that handles objects or cushion packages. In one example, in the system 570 shown in FIG. 10A, the simplified form-fill-seal system 530' could be replaced by a simplified box formation system that forms a cardboard box around the cushion packages. In another example, in the system 570 shown in FIG. 10A, the simplified form-fill-seal system 530' could be replaced by an opaque shrink wrap system that forms heat-shrinkable opaque film around the cushion packages and then shrinks the heat-shrinkable film around the cushion packages. In yet another example, in the system 580 shown in FIG. 10B, the form-fill-seal system 530 could be replaced by a transparent shrink wrap system that forms transparent heat-shrinkable film around the objects and then shrink the heat-shrinkable film around the objects before the object and the heat-shrunk film are passed to the simplified cushion package formation system 510' for formation of cushion packages.

Figure 11:
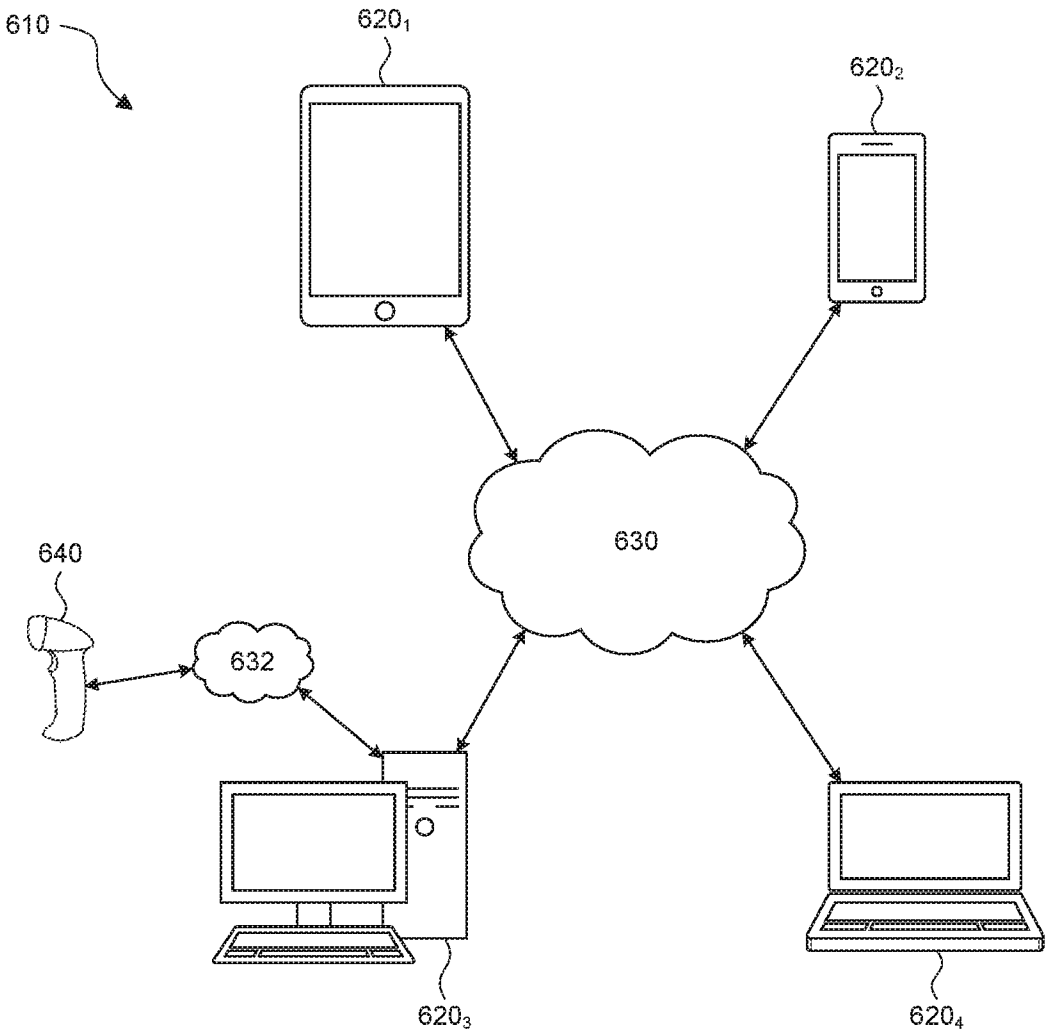
FIG. 11 depicts an example embodiment of a system that may be used to implement some or all of the embodiments described herein.

FIG. 11 depicts an example embodiment of a system 610 that may be used to implement some or all of the embodiments described herein. In the depicted embodiment, the system 610 includes computing devices $\mathbf{620}_1$, $\mathbf{620}_2$, $\mathbf{620}_3$, and $\mathbf{620}_4$ (collectively computing devices 620). In the depicted embodiment, the computing device $\mathbf{620}_1$ is a tablet, the computing device $\mathbf{620}_2$ is a mobile phone, the computing device $\mathbf{620}_3$ is a desktop computer, and the computing device $\mathbf{620}_4$ is a laptop computer. In other embodiments, the computing devices 620 include one or more of a desktop computer, a mobile phone, a tablet, a phablet, a notebook computer, a laptop computer, a distributed system, a gaming console (e.g., Xbox, Play Station, Wii), a watch, a pair of glasses, a key fob, a radio frequency identification (RFID) tag, an ear piece, a scanner, a television, a dongle, a camera, a wristband, a wearable item, a kiosk, an input terminal, a server, a server network, a blade, a gateway, a switch, a processing device, a processing entity, a set-top box, a relay, a router, a network access point, a base station, any other device configured to perform the functions, operations, and/or processes described herein, or any combination thereof.

The computing devices 620 are communicatively coupled to each other via one or more networks 630 and 632. Each of the networks 630 and 632 may include one or more wired or wireless networks (e.g., a 3G network, the Internet, an internal network, a proprietary network, a secured network). The computing devices 620 are capable of communicating with each other and/or any other computing devices via one or more wired or wireless networks. While the particular system 610 in FIG. 11 depicts that the computing devices 620 communicatively coupled via the network 630 include four computing devices, any number of computing devices may be communicatively coupled via the network 630.

In the depicted embodiment, the computing device $\mathbf{620}_3$ is communicatively coupled with a peripheral device 640 via the network 632. In the depicted embodiment, the peripheral device 640 is a scanner, such as a barcode scanner, an optical scanner, a computer vision device, and the like. In some embodiments, the network 632 is a wired network (e.g., a direct wired connection between the peripheral device 640 and the computing device $\mathbf{620}_3$), a wireless network (e.g., a Bluetooth connection or a WiFi connection), or a combination of wired and wireless networks (e.g., a Bluetooth connection between the peripheral device 640 and a cradle of the peripheral device 640 and a wired connection between the peripheral device 640 and the computing device $\mathbf{620}_3$). In some embodiments, the peripheral device 640 is itself a computing device (sometimes called a "smart" device). In other embodiments, the peripheral device 640 is not a computing device (sometimes called a "dumb" device).

Figure 12:
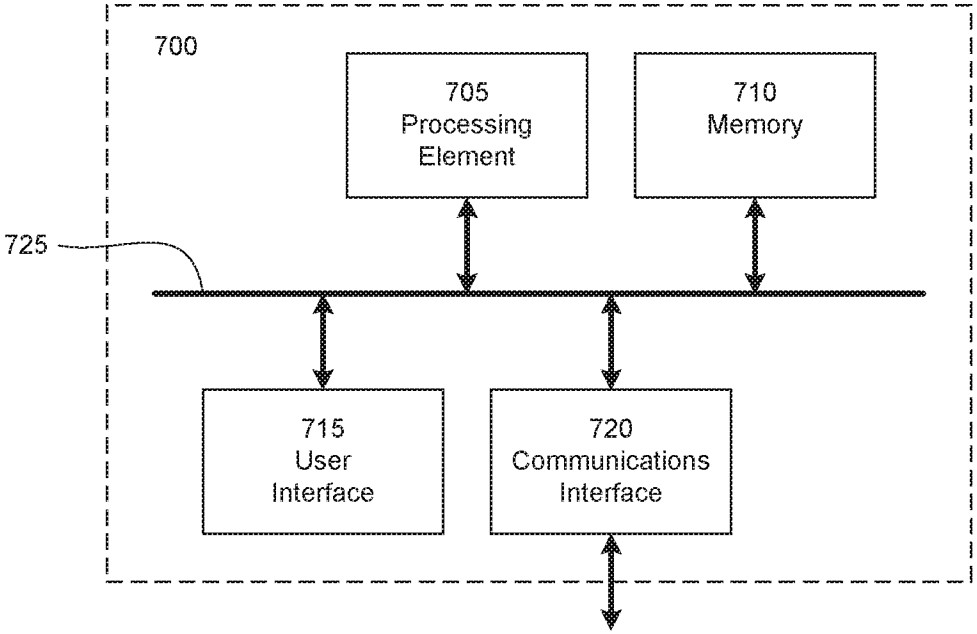
FIG. 12 depicts a block diagram of an embodiment of a computing device, in accordance with the embodiments described herein.

Depicted in FIG. 12 is a block diagram of an embodiment of a computing device 700. Any of the computing devices 620 and/or any other computing device described herein may include some or all of the components and features of the computing device 700. In some embodiments, the computing device 700 is one or more of a desktop computer, a mobile phone, a tablet, a phablet, a notebook computer, a laptop computer, a distributed system, a gaming console (e.g., an Xbox, a Play Station, a Wii), a watch, a pair of glasses, a key fob, a radio frequency identification (RFID) tag, an ear piece, a scanner, a television, a dongle, a camera, a wristband, a wearable item, a kiosk, an input terminal, a server, a server network, a blade, a gateway, a switch, a processing device, a processing entity, a set-top box, a relay, a router, a network access point, a base station, any other device configured to perform the functions, operations, and/or processes described herein, or any combination thereof. Such functions, operations, and/or processes may include, for example, transmitting, receiving, operating on, processing, displaying, storing, determining, creating/generating, monitoring, evaluating, comparing, and/or similar terms used herein. In one embodiment, these functions, operations, and/or processes can be performed on data, content, information, and/or similar terms used herein.

In the depicted embodiment, the computing device 700 includes a processing element 705, memory 710, a user interface 715, and a communications interface 720. The processing element 705, memory 710, a user interface 715, and a communications interface 720 are capable of communicating via a communication bus 725 by reading data from and/or writing data to the communication bus 725. The computing device 700 may include other components that are capable of communicating via the communication bus 725. In other embodiments, the computing device does not include the communication bus 725 and the components of the computing device 700 are capable of communicating with each other in some other way.

The processing element 705 (also referred to as one or more processors, processing circuitry, and/or similar terms used herein) is capable of performing operations on some external data source. For example, the processing element may perform operations on data in the memory 710, data receives via the user interface 715, and/or data received via the communications interface 720. As will be understood, the processing element 705 may be embodied in a number of different ways. In some embodiments, the processing element 705 includes one or more complex programmable logic devices (CPLDs), microprocessors, multi-core processors, co processing entities, application-specific instruction-set processors (ASIPs), microcontrollers, controllers, integrated circuits, application specific integrated circuits (ASICs), field programmable gate arrays (FPGAs), programmable logic arrays (PLAs), hardware accelerators, any other circuitry, or any combination thereof. The term circuitry may refer to an entirely hardware embodiment or a combination of hardware and computer program products. In some embodiments, the processing element 705 is configured for a particular use or configured to execute instructions stored in volatile or nonvolatile media or otherwise accessible to the processing element 705. As such, whether configured by hardware or computer program products, or by a combination thereof, the processing element 705 may be capable of performing steps or operations when configured accordingly.

The memory 710 in the computing device 700 is configured to store data, computer-executable instructions, and/or any other information. In some embodiments, the memory 710 includes volatile memory (also referred to as volatile storage, volatile media, volatile memory circuitry, and the like), non-volatile memory (also referred to as non-volatile storage, non-volatile media, non-volatile memory circuitry, and the like), or some combination thereof.

In some embodiments, volatile memory includes one or more of random access memory (RAM), dynamic random access memory (DRAM), static random access memory (SRAM), fast page mode dynamic random access memory (FPM DRAM), extended data-out dynamic random access memory (EDO DRAM), synchronous dynamic random access memory (SDRAM), double data rate synchronous dynamic random access memory (DDR SDRAM), double data rate type two synchronous dynamic random access memory (DDR2 SDRAM), double data rate type three synchronous dynamic random access memory (DDR3 SDRAM), Rambus dynamic random access memory (RDRAM), Twin Transistor RAM (TTRAM), Thyristor RAM (T-RAM), Zero-capacitor (Z-RAM), Rambus in-line memory module (RIMM), dual in-line memory module (DIMM), single in-line memory module (SIMM), video random access memory (VRAM), cache memory (including various levels), flash memory, any other memory that requires power to store information, or any combination thereof.

In some embodiments, non-volatile memory includes one or more of hard disks, floppy disks, flexible disks, solid-state storage (SSS) (e.g., a solid state drive (SSD)), solid state cards (SSC), solid state modules (SSM), enterprise flash drives, magnetic tapes, any other non-transitory magnetic media, compact disc read only memory (CD ROM), compact disc-rewritable (CD-RW), digital versatile disc (DVD), Blu-ray disc (BD), any other non-transitory optical media, read-only memory (ROM), programmable read-only memory (PROM), erasable programmable read-only memory (EPROM), electrically erasable programmable read-only memory (EEPROM), flash memory (e.g., Serial, NAND, NOR, and/or the like), multimedia memory cards (MMC), secure digital (SD) memory cards, Memory Sticks, conductive-bridging random access memory (CBRAM), phase-change random access memory (PRAM), ferroelectric random-access memory (FeRAM), non-volatile random access memory (NVRAM), magneto-resistive random access memory (MRAM), resistive random-access memory (RRAM), Silicon Oxide-Nitride-Oxide-Silicon memory (SONOS), floating junction gate random access memory (FJG RAM), Millipede memory, racetrack memory, any other memory that does not require power to store information, or any combination thereof.

In some embodiments, memory 710 is capable of storing one or more of databases, database instances, database management systems, data, applications, programs, program modules, scripts, source code, object code, byte code, compiled code, interpreted code, machine code, executable instructions, or any other information. The term database, database instance, database management system, and/or similar terms used herein may refer to a collection of records or data that is stored in a computer-readable storage medium using one or more database models, such as a hierarchical database model, network model, relational model, entity relationship model, object model, document model, semantic model, graph model, or any other model.

The user interface 715 of the computing device 700 is in communication with one or more input or output devices that are capable of receiving inputs into and/or outputting any outputs from the computing device 700. Embodiments of input devices include a keyboard, a mouse, a touchscreen display, a touch sensitive pad, a motion input device, movement input device, an audio input, a pointing device input, a joystick input, a keypad input, peripheral device 640, foot switch, and the like. Embodiments of output devices include an audio output device, a video output, a display device, a motion output device, a movement output device, a printing device, and the like. In some embodiments, the user interface 715 includes hardware that is configured to communicate with one or more input devices and/or output devices via wired and/or wireless connections.

The communications interface 720 is capable of communicating with various computing devices and/or networks. In some embodiments, the communications interface 720 is capable of communicating data, content, and/or any other information, that can be transmitted, received, operated on, processed, displayed, stored, and the like. Communication via the communications interface 720 may be executed using a wired data transmission protocol, such as fiber distributed data interface (FDDI), digital subscriber line (DSL), Ethernet, asynchronous transfer mode (ATM), frame relay, data over cable service interface specification (DOCSIS), or any other wired transmission protocol. Similarly, communication via the communications interface 720 may be executed using a wireless data transmission protocol, such as general packet radio service (GPRS), Universal Mobile Telecommunications System (UMTS), Code Division Multiple Access 2000 (CDMA2000), CDMA2000 1× (1×RTT), Wideband Code Division Multiple Access (WCDMA), Global System for Mobile Communications (GSM), Enhanced Data rates for GSM Evolution (EDGE), Time Division-Synchronous Code Division Multiple Access (TD-SCDMA), Long Term Evolution (LTE), Evolved Universal Terrestrial Radio Access Network (E-UTRAN), Evolution-Data Optimized (EVDO), High Speed Packet Access (HSPA), High-Speed Downlink Packet Access (HSDPA), IEEE 802.11 (WiFi), WiFi Direct, 802.16 (WiMAX), ultra wideband (UWB), infrared (IR) protocols, near field communication (NFC) protocols, Wibree, Bluetooth protocols, wireless universal serial bus (USB) protocols, or any other wireless protocol.

As will be appreciated by those skilled in the art, one or more components of the computing device 700 may be located remotely from other components of the computing device 700 components, such as in a distributed system. Furthermore, one or more of the components may be combined and additional components performing functions described herein may be included in the computing device 700. Thus, the computing device 700 can be adapted to accommodate a variety of needs and circumstances. The depicted and described architectures and descriptions are provided for exemplary purposes only and are not limiting to the various embodiments described herein.

Embodiments described herein may be implemented in various ways, including as computer program products that comprise articles of manufacture. A computer program product may include a non-transitory computer-readable storage medium storing applications, programs, program modules, scripts, source code, program code, object code, byte code, compiled code, interpreted code, machine code, executable instructions, and/or the like (also referred to herein as executable instructions, instructions for execution, computer program products, program code, and/or similar terms used herein interchangeably). Such non-transitory computer-readable storage media include all computer-readable media (including volatile and non-volatile media).

As should be appreciated, various embodiments of the embodiments described herein may also be implemented as methods, apparatus, systems, computing devices, and the like. As such, embodiments described herein may take the form of an apparatus, system, computing device, and the like executing instructions stored on a computer readable storage medium to perform certain steps or operations. Thus, embodiments described herein may be implemented entirely in hardware, entirely in a computer program product, or in an embodiment that comprises combination of computer program products and hardware performing certain steps or operations.

Embodiments described herein may be made with reference to block diagrams and flowchart illustrations. Thus, it should be understood that blocks of a block diagram and flowchart illustrations may be implemented in the form of a computer program product, in an entirely hardware embodiment, in a combination of hardware and computer program products, or in apparatus, systems, computing devices, and the like carrying out instructions, operations, or steps. Such instructions, operations, or steps may be stored on a computer readable storage medium for execution buy a processing element in a computing device. For example, retrieval, loading, and execution of code may be performed sequentially such that one instruction is retrieved, loaded, and executed at a time. In some exemplary embodiments, retrieval, loading, and/or execution may be performed in parallel such that multiple instructions are retrieved, loaded, and/or executed together. Thus, such embodiments can produce specifically configured machines performing the steps or operations specified in the block diagrams and flowchart illustrations. Accordingly, the block diagrams and flowchart illustrations support various combinations of embodiments for performing the specified instructions, operations, or steps.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A method of forming a cushion package, the method comprising:

feeding a cushion material from a supply of the cushion material, the cushion material having two longitudinal edges, wherein the cushion material comprises at least one of an air cellular sheet material and a foamed material;

folding the cushion material, as the cushion material is being fed, until the cushion material is formed into a tube of the cushion material and the two longitudinal edges are in an overlapping position;

forming a first transverse seal in the tube of the cushion material after folding the cushion material, wherein the first transverse seal forms a first end of the cushion package;

forming a second transverse seal in the tube of the cushion material longitudinally spaced away from the first transverse seal, wherein the second transverse seal forms a second end of the cushion package; and holding the two longitudinal edges in the overlapping position as the cushion material is fed from a location where the two longitudinal edges are in the overlapping position and a location where the first and second transverse seals are formed, wherein the two longitudinal edges are held in the overlapping position by at least one of:

at least by one roller located above the two longitudinal edges in the overlapping position, or an overhead conveyor having a hanging underside that contacts the tube of the cushion material at least where the two longitudinal edges are in the overlapping position;

wherein each of the first transverse seal and the second transverse seal seals the cushion material with the two longitudinal edges in the overlapping position;

wherein the two longitudinal edges of the cushion material are uncoupled between the first and second transverse seals.

2. The method of claim 1, further comprising:

feeding an object onto the cushion material before the two longitudinal edges are in the overlapping position.

3. The method of claim 2, wherein the object is located within the tube of the cushion material after the tube of the cushion material is formed.

4. The method of claim 2, wherein the object is located between the first and second transverse seals after the first and second transverse seals are formed.

5. The method of claim 2, further comprising:

determining a longitudinal length of the object; and determining a longitudinal length of the cushion package based on the longitudinal length of the object.

6. The method of claim 1, further comprising:

feeding a plurality of objects onto the cushion material;

forming a plurality of cushion packages, wherein each of the plurality of cushion packages is formed around one or more of the plurality of objects.

7. The method of claim 1, further comprising:

placing the cushion package in an external container.

8. The method of claim 7, wherein the external container includes at least one of:

an opaque shrink wrap, wherein an inner surface of the opaque shrink wrap is in contact with an exterior surface of the cushion package;

a bag formed from a polymer-based film; or a box formed from a corrugated paper material.

9. A system for creating a cushion package, comprising:

a supply of cushion material configured to feed the cushion material in an unfolded state, wherein the cushion material has two longitudinal edges, wherein the cushion material comprises at least one of an air cellular sheet material and a foamed material;

a folding system configured to folding the cushion material from the unfolded state into a tube of the cushion material with the two longitudinal edges in an overlapping position;

a sealing mechanism configured to:

form a first transverse seal in the tube of the cushion material, wherein the first transverse seal forms a first end of the cushion package, and form a second transverse seal in the tube of the cushion material downstream of the first transverse seal, wherein the second transverse seal forms a second end of the cushion package, wherein each of the first transverse seal and the second transverse seal seals the cushion material with the two longitudinal edges in the overlapping position;

wherein the two longitudinal edges of the cushion material are uncoupled between the first and second transverse seals; and a holding mechanism configured to hold the two longitudinal edges in the overlapping position as the cushion material is fed between the folding system and the sealing mechanism, wherein the holding mechanism comprises at least one of:

at least by one roller located above the two longitudinal edges in the overlapping position, or an overhead conveyor having a hanging underside that contacts the tube of the cushion material at least where the two longitudinal edges are in the overlapping position.

10. The system of claim 9, wherein the folding system comprises at least two pairs of forming rollers configured to direct the cushion material from the unfolded state into the tube of the cushion material.

11. The system of claim 9, further comprising:

a conveyor system configured to feed objects onto the cushion material before the two longitudinal edges are in the overlapping position.

12. The system of claim 11, wherein the conveyor system is configured to feed at least one object onto the cushion material so that the tube of the cushion material is formed around the at least one object.

13. The system of claim 12, further comprising:

a labeling mechanism configured to apply a label to an exterior of the cushion package, wherein the label includes at least one of an indication of the at least one object, an indication of a shipping destination of the at least one object, or an indication of an order associated with the at least one object.

14. The system of claim 13, wherein:

the labeling mechanism includes a printer configured to print the label;

the labeling mechanism is configured to apply the label by either:

printing the label directly on the exterior of the of the cushion package, or printing the label on an adhesive medium and applying the adhesive medium to the exterior of the of the cushion package; and a location of the labeling mechanism is either:

upstream of the sealing mechanism and after the cushion package is folded into the tube, or downstream of the sealing mechanism.

15. A system comprising:

a cushion formation system configured to form cushion material into a tube of the cushion material, the cushion material having two longitudinal edges, wherein the two longitudinal edges of the cushion material are uncoupled in the tube of the cushion material, and wherein the cushion material comprises at least one of an air cellular sheet material and a foamed material;

a conveyor system configured to feed objects onto the cushion material so that the object is fed into the tube of the cushion material;

a shell formation system configured to form a shell material into a tube of the shell material, wherein the system is configured to feed the tube of the cushion material into the tube of the shell material while the object is inside the tube of the cushion material; and a sealing mechanism configured to:

form a first transverse seal upstream of the object, wherein the first transverse seal is formed through both the cushion material in the tube of the cushion material and the shell material in the tube of the shell material, and form a second transverse seal downstream of the object, wherein the second transverse seal is formed through both the cushion material in the tube of the cushion material and the shell material in the tube of the shell material, wherein the two longitudinal edges of the cushion material are uncoupled between the first and second transverse seals.

16. The system of claim 15, wherein the cushion material is an inflatable cellular material, and wherein the shell material is a polymer-based film.

17. The system of claim 15, further comprising:

a folding system configured to folding the cushion material from an unfolded state into the tube of the cushion material;

wherein the cushion material includes two longitudinal edges; and wherein the two longitudinal edges are in an overlapping position in the tube of the cushion material.

18. The system of claim 15, wherein the cushion material is not sealed between the first and second transverse seals.

* * * * *